US006003714A

United States Patent [19]

Buermann

[11] Patent Number: 6,003,714

[45] Date of Patent: Dec. 21, 1999

[54] COMPRESSED GAS CYLINDER SAFETY CAP AND VALVE SEAL RETAINER

[76] Inventor: Henry Buermann, R. R. 1, East Hill, Brookfield, Vt. 05036

[21] Appl. No.: 09/132,560

[22] Filed: Aug. 11, 1998

[51] Int. Cl.[6] ..... B65D 17/34; B65D 55/06

[52] U.S. Cl. ..... 220/270; 24/30.5 P; 137/384; 220/725; 292/307 R; 292/317

[58] Field of Search ..... 24/30.5 P; 292/307 R, 292/307 B, 307 A, 308, 317–319, 322, 325; 220/265, 724, 745, 582, 583, 913; 215/253, 257, 250, 254, 26, 28, 29

[56] References Cited

U.S. PATENT DOCUMENTS

| | | | |
|---|---|---|---|
| 3,102,311 | 9/1963 | Martin et al. | 24/30.5 P X |
| 3,556,575 | 1/1971 | Farkas | 292/318 X |
| 4,615,185 | 10/1986 | Bollinger | 24/30.5 P X |
| 5,267,373 | 12/1993 | Chisek | 24/30.5 P X |
| 5,550,794 | 8/1996 | Born et al. | 368/11 |
| 5,664,294 | 9/1997 | Sorensen et al. | 24/30.5 P X |
| 5,745,957 | 5/1998 | Khokhar et al. | 24/30.5 P X |
| 5,884,367 | 3/1999 | Teagno et al. | 24/30.5 P X |
| 5,911,368 | 6/1999 | Davingnon | 24/30.5 P X |

*Primary Examiner*—Allan N. Shoap
*Assistant Examiner*—Rodrigo L. Eichwald
*Attorney, Agent, or Firm*—Kevin Ellicott, Esq.

[57] ABSTRACT

A compressed gas cylinder safety cap and valve seal retainer comprising a cap having a floor, a wall and a stem, the wall extending perpendicularly from and circumferentially around the floor, the stem extending perpendicularly from the floor at the central axis of the floor; a second strap connected at its proximal end to the cap, the second strap having a pair of bendable areas, a tear tab and perforations, a second strap angled portion attached at its proximal end to the second strap and at its distal end to a clasp tab, the clasp tab having a double ridged portion extending perpendicularly away from the clasp tab, the double ridged portion having a first set of ridges and a second set of ridges offset from the first set of ridges; a first strap, the first strap being connected at its proximal end to the cap, the first strap having at its distal end a clasp receptacle, the clasp receptacle having a hollow interior, the hollow interior having mounted therein on an interior surface a series of ridges and on an opposite interior surface a biased armature, the clasp receptacle further having a proximal end opening and a distal end opening, the proximal end opening and the distal end opening being sized and shaped for the insertion therethrough of the clasp tab.

14 Claims, 8 Drawing Sheets

COMPRESSED GAS CYLINDER SAFETY CAP AND VALVE SEAL RETAINER

CROSS REFERENCE TO OTHER APPLICATIONS

This is the first submission of an application for this article of manufacture. There are no other applications, provisional or non provisional.

FEDERALLY SPONSORED RESEARCH AND DEVELOPMENT

There are no federally sponsored or funded research or development projects or undertakings in any way associated with the instant invention.

BACKGROUND OF THE INVENTION

1. Field of the Invention

The instant invention relates to that field of devices consisting of articles of manufacture known as safety caps. Specifically, the instant invention is a disposable, one time use safety cap and valve seal retainer for cylinders holding compressed gas.

2. Background Information

The prior art known to applicant discloses that single use safety caps are reasonably well known. These safety caps have been utilized in conjunction with a great number of different containers, the containers holding diverse materials. For example, Applicant is aware of safety caps intended to be used with beer containers (Hanks et al., U.S. Pat. No. 4,457,445) and other liquids (Hoffman et al., U.S. Pat. No. 5,090,583). Unfortunately, none of the above prior art patents provides a safe, efficient and easy to use way to prevent intrusion into a gas cylinder valve.

In Hanks, for example, the cap is a two piece device having a closure tab and a tear strip. This device could be used in conjunction with a gas cylinder valve, however, due to the nature of the tab, the user would have to exercise great caution to ensure that the tab was completely engaged into its receptacle. Failure to exercise such caution would likely lead to a failure of the device, thereby negating the benefit of the safety cap.

In Hoffman, the cap is a single piece structure having a cap at its midpoint and a ring at each end. The first ring is attached to the cap. The second ring is applied over the neck of the container while the container's dispensing spout is attached. Unfortunately, such an arrangement would not be satisfactory when used in conjunction with a compressed gas bottle. In the case of a compressed gas bottle, the valve must be in place prior to filling of the bottle. It would be impossible to attach the safety cap to the bottle and or valve, and then fill the bottle with the safety cap in place.

Applicant has therefore invented a device which call be applied after the valve has been attached and the cylinder filled. Furthermore, Applicant's invention will remain in place even if its tab is not completely engaged with its receptacle. In terms of assembly labor, this is extremely important. Compressed gas cylinders are often filled in an "assembly line" fashion. The workers applying safety caps must work quickly, and cannot easily stop to re-check a safety cap to ensure its attachment to the cylinder. Under circumstances such as this, it is not at all unusual for the safety caps to be only partially attached, and hence likely to fall apart during transit.

SUMMARY OF THE INVENTION

The instant invention is a safety cap and valve seal retainer for use with compressed gas cylinders. The instant invention differs from the prior art in that it not only prevents the intrusion of unwanted materials into the valve but also ensures retention of the valve seal during transportation of the cylinder These objects of the invention are accomplished through the use of a safety cap having a recessed area into which the valve seal sets and by the inclusion of a stem protruding from the center of the safety cap recessed area, the stem extending into the area of the valve in which a regulator would be attached prior to use.

A further object of the invention is to provide a clasp mechanism which is simple to close, and highly unlikely to come apart, even if not fully closed during its assembly onto a compressed gas cylinder. In the prior art known to Applicant, safety caps have been configured such that the person assembling the device must exercise caution when doing so to ensure that the cap is fully closed. Failure to fully close the cap often results in the cap falling apart while being transported, negating any benefit of having a safety cap.

Applicant overcomes this problem in the prior art by incorporating a clasp having a tab and a receptacle for accepting the tab as part of the instant invention. The tab has a double ridged portion extending upward, perpendicularly from the tab. The double ridged portion has a series of ridges along either side of it, while the receptacle has a hollow interior having mounted therein a series of ridges for interlocking with one set of ridges on the tab, and a biased armature for interlocking with the other set of ridges on the tab. Another object of the present invention therefore is a device which may be attached quickly, and if even only one set of ridges on the tab and clasp engage one another, the device will remain closed. This is a significant improvement over the prior art which required far more care during assembly in order to prevent the safety cap from being incompletely attached and hence likely to fall off during transport.

Furthermore, Applicant is aware that safety caps for compressed gas cylinders have often required soaking in warm water before applying. This was done to expand the retaining strap so that it would fit over the compressed gas cylinder valve, and after cooling, tighten around the valve. Applicant has found such an arrangement to be highly unsatisfactory as it has the potential of trapping warm water between the safety cap and the valve, providing a ready area for the growth of bacteria, molds, mildews and like organisms. Therefore, it is a further object of the instant invention to provide a safety cap which does not require soaking in warm water before applying, and therefore eliminates possible growth of detrimental organisms. Applicant accomplishes this objective through use of the clasp and tab, combined with weakened bendable areas so that the device may be easily bent around the valve, and then fastened firmly without resorting to pre-soaking or warming of the device.

Finally, a further object of the invention is to provide a safety cap which prevents the compressed gas cylinder from being tampered with and revealing any successful attempt at tampering. Applicant's device accomplishes this objective with the stem protruding from the safety cap recessed area. When in place, the stem of the safety cap serves to positively index the orientation of the device, thereby completely covering the compressed gas cylinder valve orifice and rendering it impossible to obtain access to that orifice without first damaging the safety cap, and making it obvious that tampering has taken place.

A DESCRIPTION OF THE DRAWINGS

A DESCRIPTION OF THE PREFERRED EMBODIMENT

Figure 1:
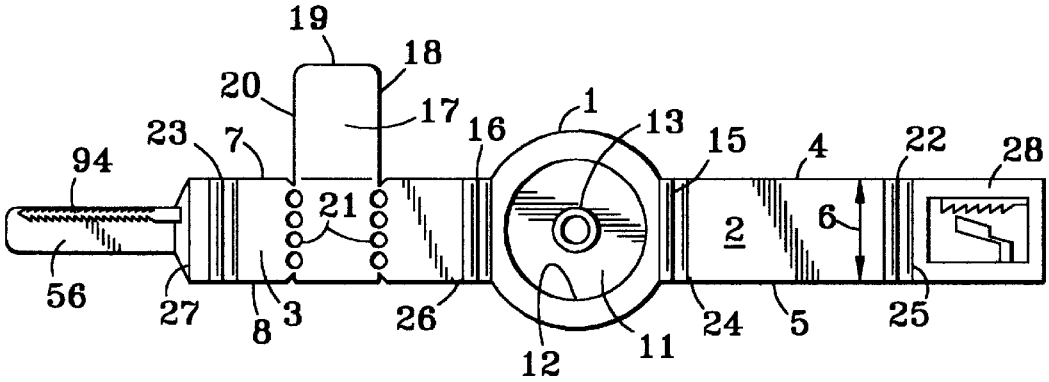
FIG. 1 is a plan view showing the compressed gas cylinder safety cap.

As per FIG. 1, the instant invention has a cap (1). In the preferred embodiment, the cap (1) is essentially discoidal. The cap (1) has extending therefrom a first strap (2) and a second strap (3). The first strap (2) is essentially rectangular and has a first strap dorsal surface (125), a first strap ventral surface (126) a first strap first side (4) and a first strap second side (5). The first strap dorsal surface (125) and the first strap ventral surface (126) are connected to one another by the first strap first side (4) and the first strap second side (5). The first strap further has a first strap proximal end (24) and a first strap distal end (25). In the preferred embodiment, the length of the first strap first side (that is, the distance between the first strap proximal end and the first strap distal end) is approximately 28.99 mm. The first strap first side (4) and the first strap second side (5) are parallel and co-planar. The distance between the first strap first side (4) and the first strap second side (5) defines strap width (6). In the preferred embodiment, the strap width (6) is approximately 10.46 mm. Strap width for the first strap (2) and the second strap (3) is equal.

As per FIG. 1, the second strap (3) is essentially rectangular and has a second strap dorsal surface (127), a second strap ventral surface (128), a second strap first side (7) and a second strap second side (8). The second strap dorsal surface (127) and the second strap ventral surface (128) are connected to one another by the second strap first side (7) and the second strap second side (8). The second strap further has a second strap proximal end (26) and a second strap distal end (27). In the preferred embodiment, the length of the second strap first side (that is, the distance between the second strap proximal end and the second strap distal end) is approximately 30.32 mm. The second strap first side (7) and the second strap second side (8) are parallel and co-planar. It should be understood that the first strap and the second strap are oppositely aligned on the cap (1), perpendicular to a cap inner wall (12) and are co-planar with one another.

Figure 2:
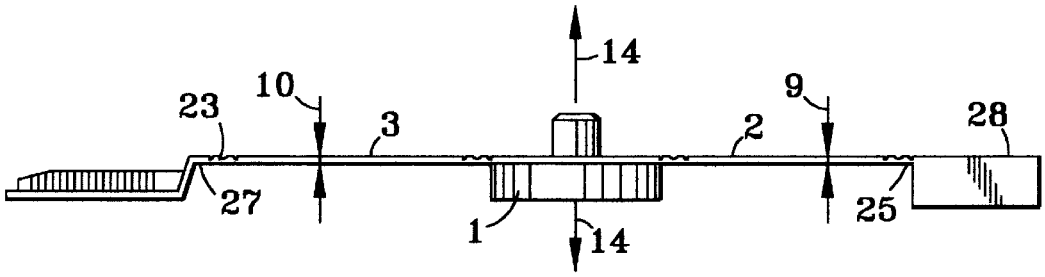
FIG. 2 is a side view showing the compressed gas cylinder safety cap.

As per FIG. 2, the first strap has first strap thickness (9) and the second strap has second strap thickness (10). In the preferred embodiment, the first strap thickness (9) and the second strap thickness (10) are equal, the thickness being approximately 0.71 mm. The first strap thickness is defined as the distance between the first strap dorsal surface (125) and the first strap ventral surface (126).

Figure 3:
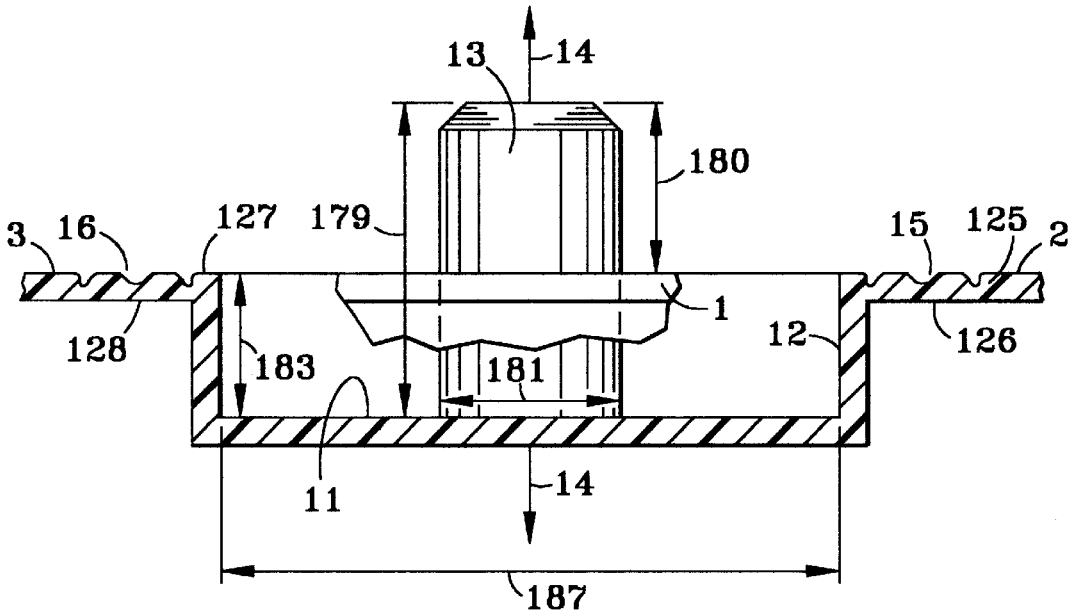
FIG. 3 is a cut away side view showing the recessed area and stem of the compressed gas cylinder safety cap.
Figure 16:
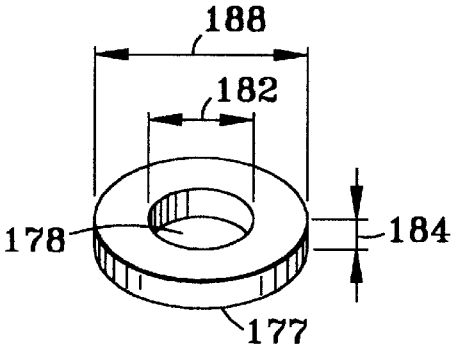
FIG. 16 is a perspective view of the valve seal.
Figure 17:
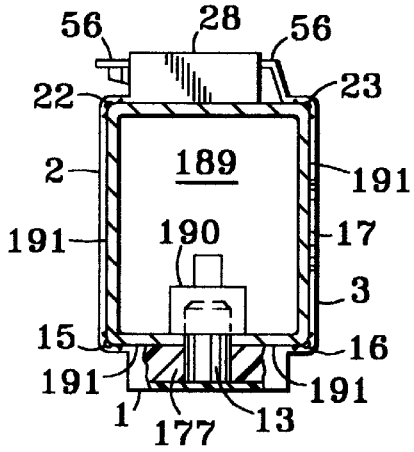
FIG. 17 is a overhead cross sectional view of the compressed gas cylinder valve with the safety cap an valve seal retainer in operation.

As per FIGS. 1 and 3, the cap portion is composed of a cap floor (11) and the cap inner wall (12) extending upwardly at a right angle therefrom. The cap floor (11) is disc shaped. The cap (1) further has a stem (13) attached thereto. The stem (13) extends upwardly from and perpendicularly (at a right angle to), the cap floor (11) and is located equidistant from the cap inner wall. The stem (13) may be cylindrical or conical in form, and may, it the end most distal from the cap floor (11) be somewhat beveled in order to better facilitate its insertion into a valve aperture. In order for the instant invention to function most efficiently, it is necessary that the stem height (179) be sufficiently great enough so that the stem extends above (180) the first strap dorsal surface (125) and the second strap dorsal surface (127). In the preferred embodiment, the stem height (179) is approximately 7.37 mm., and it extends approximately 4.27 mm. above the first strap dorsal surface. Furthermore, as per FIGS. 3 and 16, a height (183) of the cap wall (12) should be somewhat greater than a thickness (184) of the valve seal (177). In the preferred embodiment, the height (183) of the cap wall (12) is approximately 3.10 mm.

It is useful, for understanding's sake, to locate a first vertical axis (14) as passing axially through the stem, parallel to, though not co-planar with, the cap inner wall (12). The stem (13) serves both to assist in attaching the instant device to the compressed gas cylinder valve and to safely retain a valve seal (177). As per FIG. 16, the valve seal (177) is a standard valve seal well known in the industry being essentially an "O-ring", the valve seal having a hole (178) passing completely therethrough. Furthermore, in the preferred embodiment, as per FIGS. 3 and 16, the stem (13) is essentially cylindrical and has an exterior diameter (181) no greater than an interior diameter (182) of the valve seal hole (178) so that the stem (13) may pass snugly through valve seal (177). In the preferred embodiment, the exterior diameter of the stem is approximately 6.04 mm. and the interior diameter of the valve seal hole is approximately 6.55 mm. An exterior diameter of the valve seal itself (188) should be such that it fits snugly within the cap. In the preferred embodiment, the exterior diameter of the valve seal (188) is approximately 14.48 mm. Clearly, the cap inner wall interior diameter (187) should be slightly greater than the valve seal diameter. In the preferred embodiment, the cap wall interior diameter (187) is approximately 15.83 mm.

It should be understood that when viewed from the top, as per FIG. 1, the cap inner wall (12) appears as a circle, the surface of the inner wall being continuous. When viewed from the side, as per FIG. 3, the cap inner wall (12) is perpendicular to the cap floor (11). In the preferred embodiment, the cap floor (11), and the cap inner wall (12) are equal in thickness to the first strap thickness (9). Furthermore, it should be readily understood that the cap inner wall (12) and the stem (13) are co-axial with one another and with the first vertical axis (14). The circumference of the cap inner wall (12) is such that the valve seal (177) may set snugly therein, with the stem (13) passing through the valve seal hole (178).

As per FIG. 1, the first strap (2) is attached to the cap (1) at the first strap proximal end, the strap and the cap portion merging into one another. In the preferred embodiment, the instant invention is formed of a somewhat pliable plastic which is produced using any one of the injection molding techniques which are well known in the industry.

As per FIGS. 1 and 3, there is a first strap first bendable area (15) at the first strap proximal end (24), very near where the first strap (2) and the cap (1) merge. In the preferred embodiment, the first strap first bendable area is a series of parallel striations passing through the first strap dorsal surface (125) and having a depth somewhat less than the first strap thickness (9). The parallel striations of the first strap first bendable area (15) create a weakened area on the first strap, making possible to bend the strap to a 90 degree angle without weakening the strap in an unpredictable manner. In the preferred embodiment the parallel striations are actually three striations or "V" shaped grooves made in the strap, although it should be obvious to anyone skilled in the art that it would be possible to vary this number by changing the width of the striations. Applicant utilizes three striations in the preferred embodiment for purposes of accommodating compressed gas bottle valves of slightly different sizes. It should also be clear that the parallel striations extend from the first strap first side (4) to the first strap second side (5) and should be perpendicular to the first strap first side (4) and the first strap second side (5).

As per FIG. 1, the second strap (3) is attached to the cap (1) at the second strap proximal end (26), the strap and the cap portion merging into one another. As per FIGS. 1 and 3, there is a second strap first bendable area (16) at the second strap proximal end (26), very near to where the second strap (3) and the cap (1) merge. In the preferred embodiment, the second strap first bendable area (16) is a series of parallel striations passing through the second strap dorsal surface (127) and having a depth somewhat less than the second strap thickness (10), similar in configuration to the striations of the first strap first bendable area (15). The parallel striations of the second strap first bendable area (16) create a weakened area on the second strap, making possible to bend the strap to a 90 degree angle without weakening the strap in an unpredictable manner. Again, it should also be clear that the parallel striations of the second strap first bendable area (16) should be perpendicular to the first strap first side (4) and the first strap second side (5), as well as parallel to and co-planar with the parallel striations of the first strap first bendable area (15).

As per FIG. 1, the second strap further has a safety cap and valve seal retainer removal means. It should be clearly understood that once the instant invention is attached to the compressed gas cylinder, it must be removed prior to using said cylinder. Therefore, means must be provided for removing the instant invention in a controlled and predictable manner. Applicant accomplishes this goal in the preferred embodiment through the inclusion of a tear tab (17). The tear tab (17) permits the easy removal of the device from the compressed gas cylinder bottle once it is desirable to utilize said bottle. In the preferred embodiment, the tear tab extends away from the second strap at a right angle to the second strap first side (7). The tear tab may be better understood as having a tear tab right edge (18) extending away from the second strap first side (7). In the preferred embodiment, the tear tab right edge (18) has a length of approximately 12.23 mm. The tear tab right edge then meets with and merges into a tear tab terminating edge (19). In the preferred embodiment, the tear tab terminating edge has a length of approximately 9.81 mm. The tear tab terminating edge (19) is at a right angle to the tear tab right edge (18) and parallel to the second strap first side (7). The tear tab terminating edge (19) then meets with and merges into a tear tab left edge (20). The tear tab left edge (20) is at a right angle to the tear tab terminating edge and the second strap first side (7), as well as being parallel with the tear tab right edge (18). The tear tab left edge (20) then meets with and merges into the second strap first side (7). The tear tab right edge (18), the tear tab terminating edge (19) and the tear tab left edge are all co-planar with the second strap, therefore, the tear tab (17) and the second strap (3) are also co-planar. The lengths of the tear tab left edge (20) and the tear tab right edge (18) are equal to one another.

As was noted above, the purpose of including the tear tab (17) in the instant invention is to facilitate easy removal of the device. Therefore, Applicant also includes a second strap structure weakening means to be utilized in conjunction with the tear tab. In the preferred embodiment, as per FIG. 1, the second strap structure weakening means is a series of perforations which pass completely through the second strap dorsal surface (127) and second strap ventral surface (128), and extend from near the second strap first side to near the second strap second edge, the second strap weakening means being in line with the tear strap right edge (18) and the tear strap left edge (20). In the preferred embodiment, the perforations each have a diameter of approximately 1.70 mm. Naturally, this tear tab (17) could just as easily be locatable on the second strap, attached to the second strap second side (8), or to the first strap, attached to either the first strap first side (4) or the first strap second side (5). Should it be desirable to locate the tear tab on the first strap, then the second strap structure weakening means would instead be located on the first strap (and would then properly be called the first strap structure weakening means).

As per FIG. 1, the first strap has a first strap second bendable area (22). The first strap second bendable area is configured similarly to the first strap first bendable area (15) and the second strap first bendable area (16). The first strap second bendable area is locatable at the first strap distal end (25).

Figure 4:
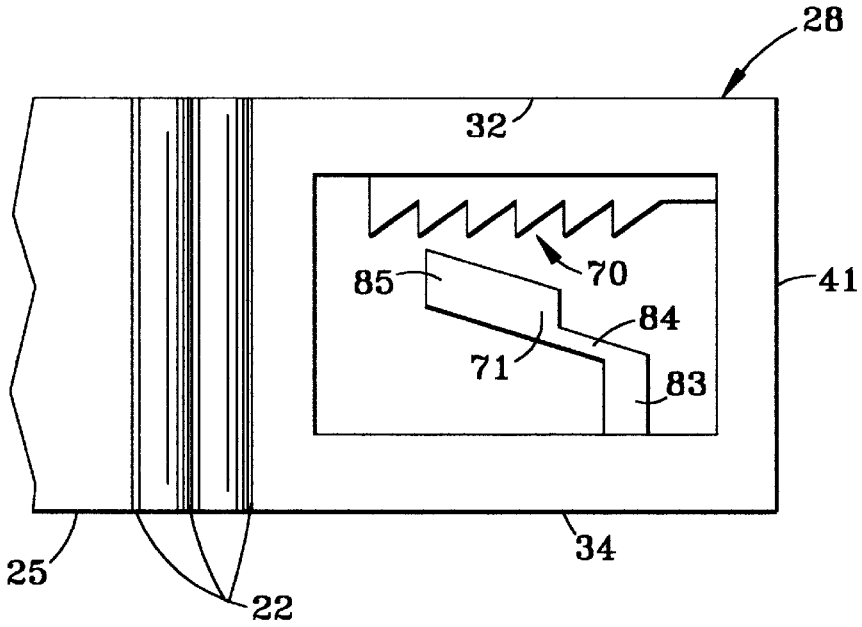
FIG. 4 is a plan view of the clasp receptacle of the compressed gas cylinder safety cap.

As per FIGS. 1, 2 and 4, the instant invention further has a clasp receptacle (28) attached to the first strap (2), distally of the first strap second bendable area (22). The clasp receptacle (28) is essentially a rectangular box having a pair ends, each end having an opening in it.

Figure 5:
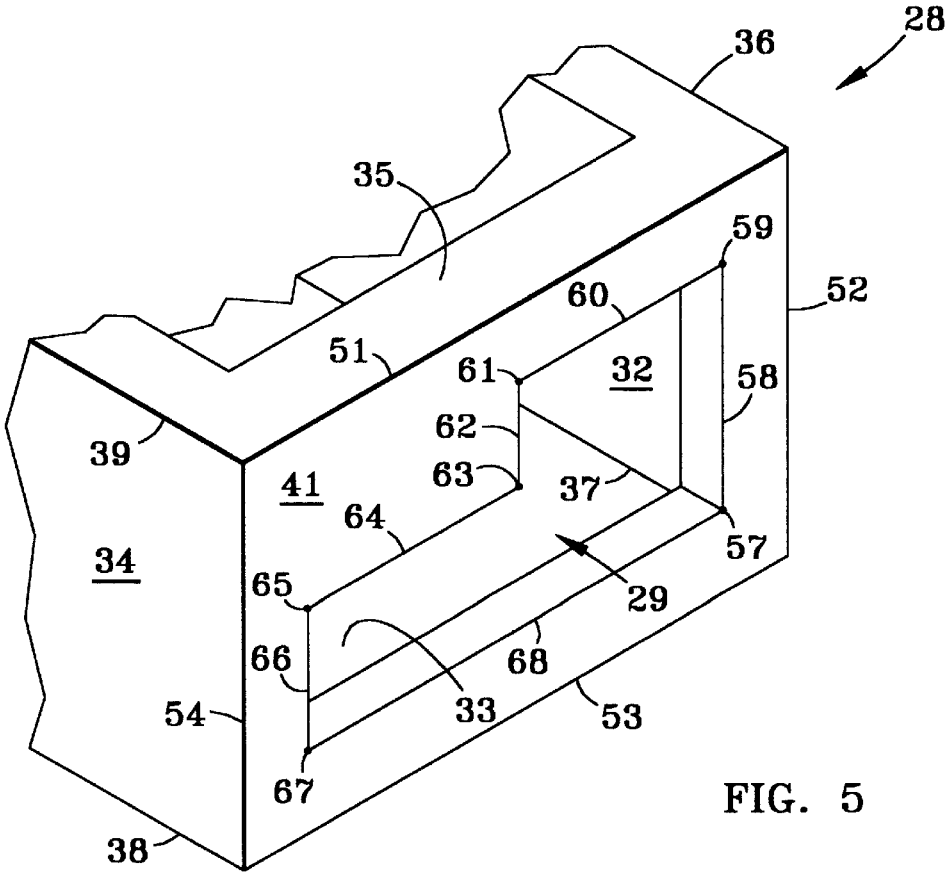
FIG. 5 is a perspective view showing a portion of the clasp receptacle including the distal end wall and the distal end wall opening of the compressed gas cylinder safety cap.
Figure 6:
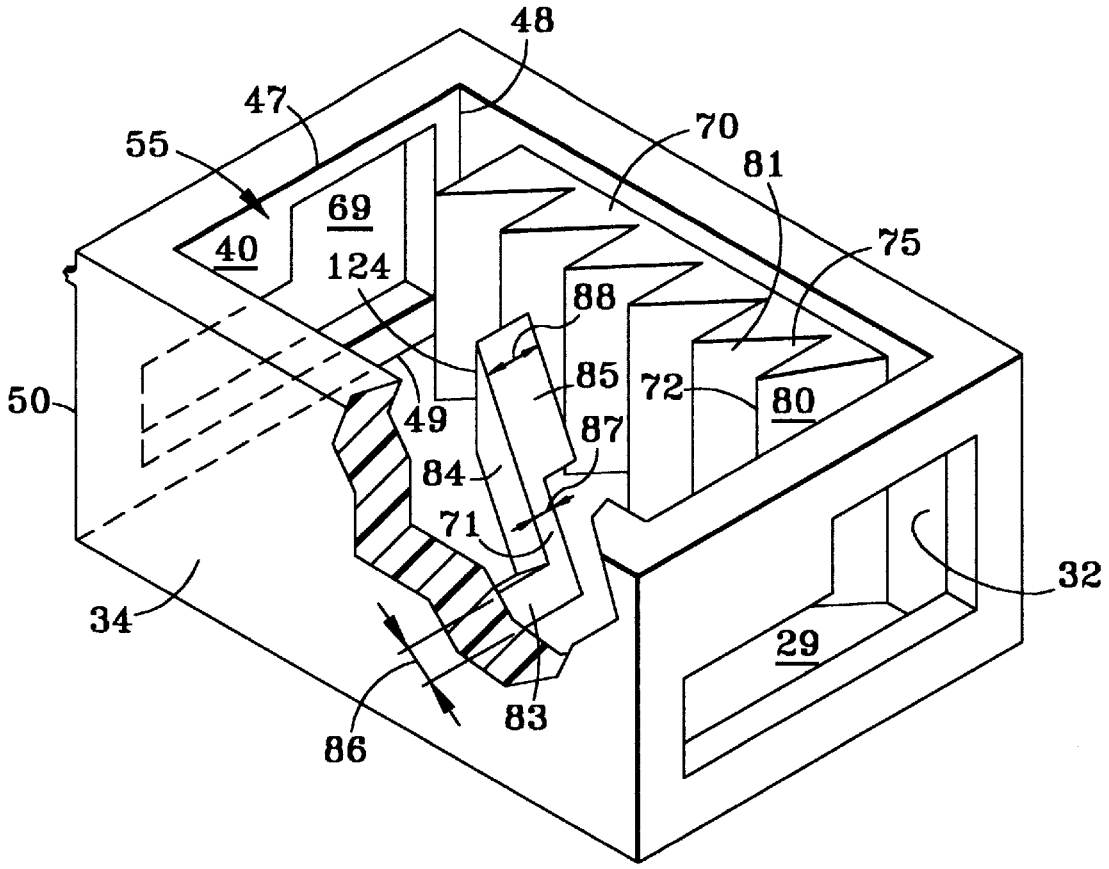
FIG. 6 is a perspective view showing the hollow interior of the clasp receptacle with the series of ridges and biased armature mounted therein.

As per FIGS. 4, 5 and 6, the clasp receptacle (28) has a first side wall (32), the first side wall having an interior surface and an exterior surface. The clasp receptacle also has a bottom wall (33), the bottom wall having an interior surface and an exterior surface. The clasp receptacle also has a second side wall (34), the second side wall having an interior surface and an exterior surface. The clasp receptacle also has a top wall (35), the top wall having an interior surface and an exterior surface, the exterior surface being coplanar with the first strap dorsal surface (125). The clasp further has a proximal end wall (40), the proximal end wall having an interior surface and an exterior surface, and a distal end wall (41), the distal end wall having an interior surface and an exterior surface.

As per FIGS. 4, 5 and 6, the first side wall (32) is attached to the bottom wall (33) along a clasp receptacle first edge (37). The bottom wall (33) is further attached to the second side wall (34) along a clasp receptacle second edge (38). The second side wall is attached to the top wall (35) along a clasp receptacle third edge (39). The top wall is further attached to the first side wall along a clasp receptacle fourth edge (36).

As per FIGS. 5 and 6, the proximal end wall (40) is attached to the top wall (35) along a fifth edge (47), to the first side wall along a sixth edge (48), to the bottom wall along a seventh edge (49), and to the second side wall along an eighth edge (50).

As per FIG. 5, the distal end wall (41) is attached to the top wall (35) along a ninth edge (51), to the first side wall along a tenth edge (52), to the bottom wall along an eleventh edge (53), and to the second side wall along a twelfth edge (54). In the preferred embodiment, the ninth edge (51) has a length of approximately 9.14 mm and the tenth edge (52) has a length of approximately 5.82 mm.

As per FIGS. 5 and 6, it should be readily apparent that in the best mode, the clasp receptacle is essentially rectangular, with the second side wall (34) and the first side wall (32) being parallel with one another, though not co-planar. It should further be apparent that the bottom wall (33) and the top wall (35) are parallel with one another though not co-planar, and that the bottom wall (33) is perpendicular iii relation to the second side wall (34). Furthermore, it should be apparent that the proximal end wall (40) and the distal end wall (41) are parallel to one another, though not co-planar, and that the distal end wall (41) is at a right angle to the second side wall (34) and the bottom wall (33).

Furthermore, it should be understood that the first side wall interior surface, the bottom wall interior surface, the second side wall interior surface, the proximal end wall interior surface and the distal end wall interior surface collectively form the clasp receptacle interior surface, and define a clasp receptacle hollow interior (55).

As per FIG. 5, the clasp receptacle distal end wall (41) has a receptacle opening (29) which passes through the distal end wall exterior surface and the distal end wall interior surface. The distal end wall receptacle opening provides access to the hollow interior portion of the clasp receptacle, and serve as the ingress means for a clasp tab (56). The distal end wall receptacle opening (29) may be better understood with recourse to a first point (57) locatable near the intersection of the tenth edge (52) and the eleventh edge (53). A clasp receptacle distal end wall opening right edge (58) extends in a straight line upwardly, from the first point (57) to a second point (59). In the preferred embodiment, the length of the clasp receptacle distal end wall opening right edge (58) is approximately 2.64 mm. The second point (59) is locatable near the intersection of the tenth edge (52) and the ninth edge (51). A clasp receptacle distal end stall opening first top edge (60) then proceeds in a straight line from the second point (59) to a third point (61). In the preferred embodiment, the length of the clasp receptacle distal end wall opening first top edge (60) is approximately 3.18 mm. A clasp receptacle distal end wall opening first left edge (62) then extends from the third point (61), in a straight line downwardly, toward the eleventh edge (53), to a fourth point (63). In the preferred embodiment, the length of the clasp receptacle distal end wall opening first left edge (62) is approximately 1.78 mm. A clasp receptacle distal end wall opening second top edge (64) then extends from the fourth point (63), in a straight line toward the twelfth edge (54), to a fifth point (65). In the preferred embodiment, the length of the clasp receptacle distal end wall opening second top edge (64) is approximately 2.92 mm. A clasp receptacle distal end wall opening second left edge (66) then extends from the fifth point (65), in a straight line downwardly, toward the eleventh edge (53), to a sixth point (67). In the preferred embodiment, the length of the clasp receptacle distal end wall opening second left edge (66) is approximately 0.86 mm. A clasp receptacle distal end wall opening bottom edge (68) then extends from the sixth point (67), in a straight line rightwardly, toward the tenth edge (52), to the first point (57). In the preferred embodiment, the length of the clasp receptacle distal end wall opening bottom edge (68) is approximately 6.10 mm.

The clasp receptacle further has a clasp receptacle proximal end wall opening (69) as well. The proximal end receptacle opening is configured and oriented such that when the clasp tab is inserted into the clasp receptacle distal end opening, and pushed far enough through the hollow interior of the clasp receptacle, the clasp tab will emerge from the clasp receptacle, passing through the clasp receptacle proximal end opening.

As per FIGS. 4 and 6, while the clasp receptacle (28) has been discussed in terms of having a hollow interior, it should be further understood that the device includes functional structural elements mounted within that hollow interior. The clasp receptacle has mounted within the hollow interior (55) a series of ridges (70) and a biased armature (71).

Figure 7:
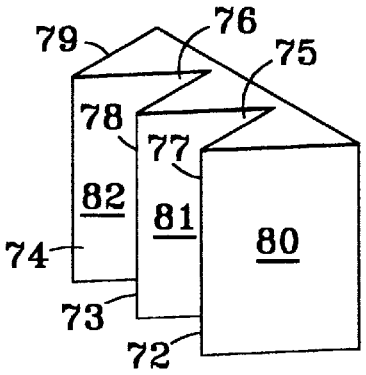
FIG. 7 is a close up view of a portion of the series of ridges.
Figure 8:
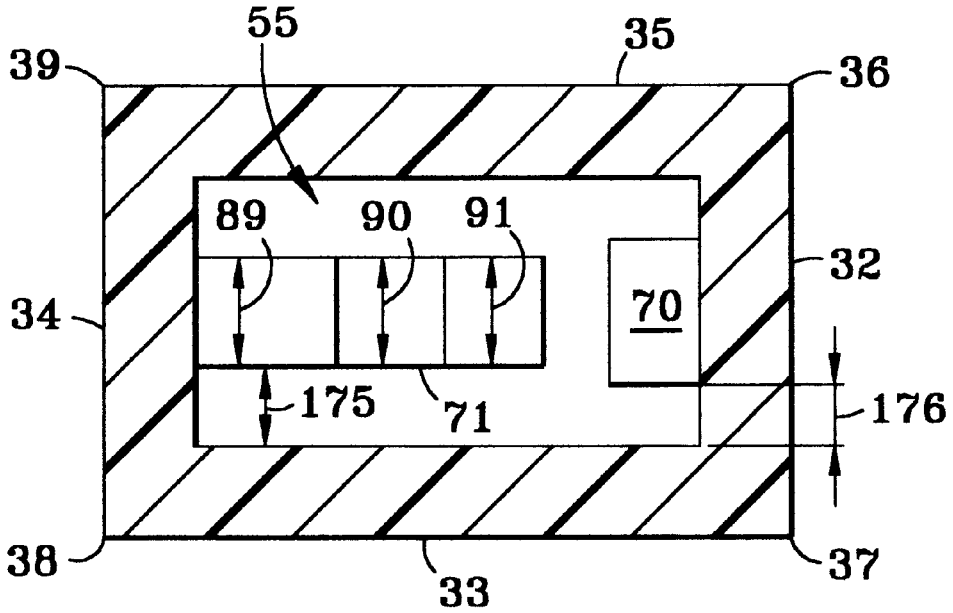
FIG. 8 is cross sectional end view of the hollow interior of the clasp receptacle with the series of ridges and biased armature mounted therein.

As per FIGS. 6 and 8, in the preferred embodiments the series of ridges (70) are attached to the clasp receptacle first side wall interior surface and are locatable approximately midway between the top wall (35) interior surface and the bottom wall (33) interior surface. As may be understood better reference to FIGS. 6 and 7, the series of ridges is essentially a group of "wedges" or three dimensional inclined planes, lined up adjacent to one another, creating a series of peaks; a first peak (72), a second peak (73), and a third peak (74) and valleys; a first valley (75) and a second valley (76). Locatable between each peak (72), (73) and (74) and valley (75) and (76) is a ridge flat wall; a ridge first flat wall (77), a ridge second flat wall (78) and a ridge third flat wall (79). Furthermore, each peak (72), (73) and (74) is connected to each valley (75) and (76) by a ridge angled wall, a ridge first angled wall (80), a ridge second angled wall (81) and a ridge third angled wall (82). In essence, each peak is the juncture of the ridge angled wall and ridge flat wall where the ridge extends farthest into the hollow interior (55), away from the first side wall (32).

For example, the ridge first angled wall (80) meets and merges into the ridge first flat wall (77) at the first peak (72). The ridge first flat wall (77) then meets and merges into the ridge second angled wall (81) at the first valley (75). The ridge second angled wall (81) then meets and merges into the ridge second flat wall (78) at the ridge second peak (73). As should be apparent, the ridge first flat wall (77), the ridge second flat wall (78) and the ridge third flat wall (79) are all parallel to and face the clasp proximal end wall (40). While the series of ridges described above has specifically described only three ridges, it should be understood that in the preferred embodiment the series of ridges will have a plurality of ridges. In the best mode known to applicant there are a sufficient number of ridges in the series so that five peaks are present. In the preferred embodiment, each angled wall has a width of approximately 1.12 mm. and each straight wall has a width of approximately 0.47 mm., resulting in a total width for the series of ridges of 5.08 mm. The height of the angled walls and the flat walls, in the preferred embodiment, is approximately 1.78 mm.

As per FIGS. 4 and 6, the clasp receptacle further has mounted therein a biased armature (71). The biased armature is attached to the second side wall (34) interior surface, opposite the series of ridges (70). In the preferred embodiment, the biased armature is constructed of the same material as the clasp receptacle, and is formed integrally thereto. Because the material from which the instant invention is constructed is somewhat flexible, the biased armature is also somewhat flexible. Furthermore, in its "at rest" or not in use position, the biased armature is normally in close proximity to the clasp receptacle series of ridges (70).

The biased armature includes a base portion (83), a thin extension portion (84) and an locking tooth portion (85). The biased armature base portion is essentially a rectangular box in form and is attached to the second side wall (34) interior surface. The biased armature extends from the second side interior surface into the hollow interior (55), perpendicularly to the second side wall and parallel to, though not co-planar with, the distal end wall (41). The base portion then merges into and becomes one with the thin extension portion (84). The thin extension portion is also essentially a rectangular box in form. The thin extension portion (84) then continues away from the base portion (83) at an acute angle relative to the base portion (83) and the second side wall (34). The thin extension portion merges into and becomes one with the locking tooth portion (85). The locking tooth portion is essentially three dimensional parallelogram box in form. The side of the locking tooth (85) which is perpendicular to the clasp receptacle second side wall (34), and most proximate to the clasp receptacle proximate end wall (40) interior surface may be referred to as the locking tooth portion flat side (124). The thin extension portion and the locking tooth portion are oriented in the same manner relative to the base portion (83). In its at rest state, the locking tooth portion flat side (124) is essentially parallel with the series of ridges flat walls and is co-planar with one of those flat walls.

As per FIGS. 6 and 8, it should be readily understood that the base portion width (86) and the locking tooth portion width (88) are essentially equal, while the thin extension width (87) is somewhat less than either the locking tooth portion width or the base portion width. In the preferred embodiment, the base portion width (86) and the locking tooth portion width (87) are approximately 1.40 mm., while the thin extension with (87) is approximately 0.61 mm. Applicant believes this is necessary in order to ensure that any bending of the biased armature which takes place when the device is in use takes place only at the thin extension portion (84). It should be further understood that the material used to construct the biased armature (71) should be somewhat flexible, yet also be somewhat resistant to bending. It is this resistance to bending which biases the armature. As was noted above, the at rest state of the biased armature should be such that the locking tooth portion (85) is in relatively close proximity to the series of ridges (70). In the preferred embodiment, the edge of the locking tooth portion most proximate to the series of ridges when the biased armature is in its at rest state (that is, the locking tooth portion sixth edge) is approximately 0.57 mm. from the series of ridges. Finally, it should be noted that in the preferred embodiment, the base portion thickness (89), the thin extension portion thickness (90) and the locking tooth portion thickness (91) are all approximately 1.78 mm.

Figure 14:
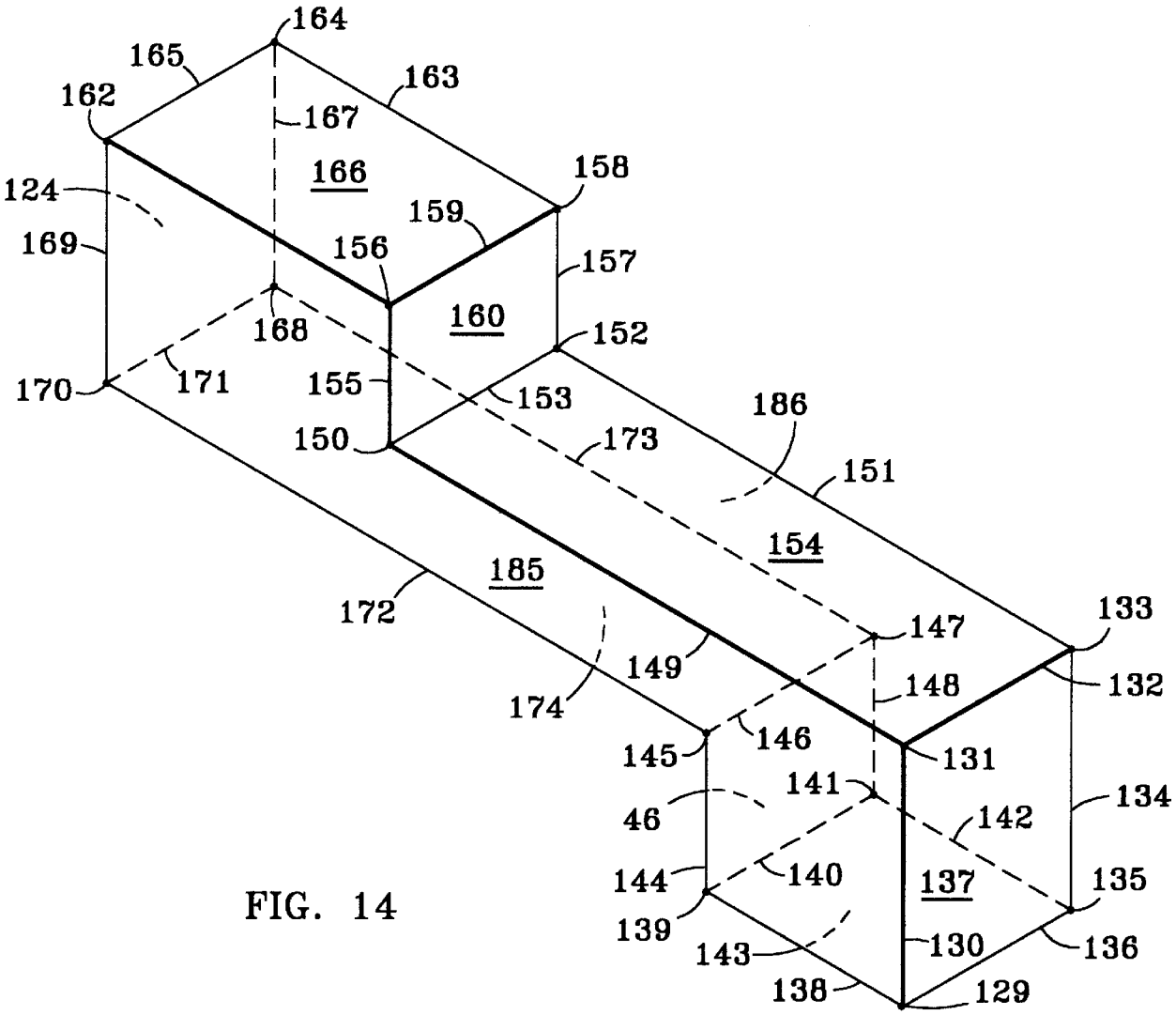
FIG. 14 is a see through perspective view of the biased armature of the compressed gas cylinder safety cap and valve seal retainer.
Figure 15:
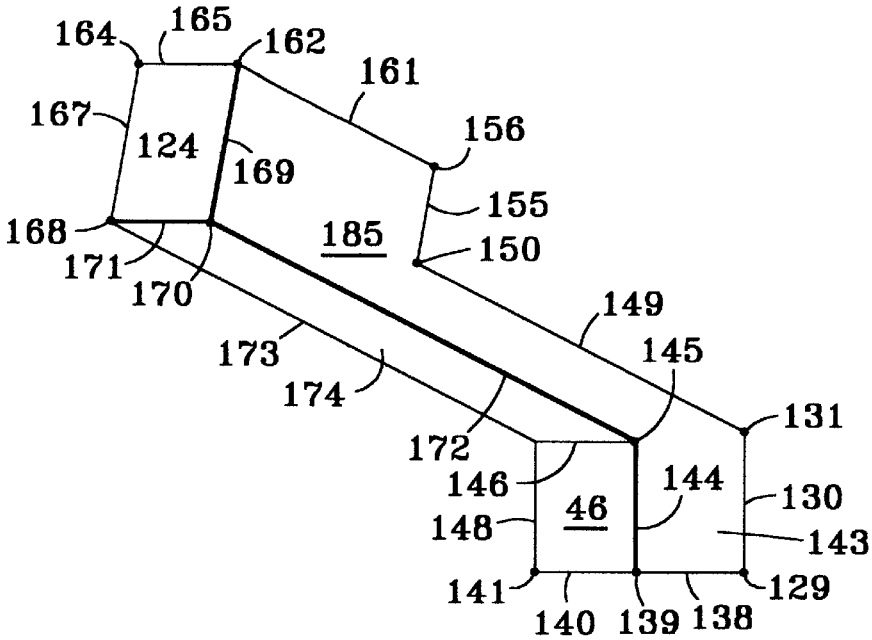
FIG. 15 is a perspective view of the biased armature of the compressed gas cylinder safety cap and valve seal retainer.

The biased armature may be further described, and better understood, with reference to FIGS. 14 and 15. Beginning at a biased armature first point (129), a biased armature base first edge (130) extends away from the clasp receptacle second side wall (34) surface, toward the clasp receptacle first side wall (32) interior surface and merges into a biased armature second point (31). In the preferred embodiment, the length of the biased armature first edge (130) is approximately 1.10 mm. A biased armature base second edge (132) then proceeds downwardly, from the biased armature second point (131) toward the clasp receptacle bottom wall (33) interior surface, meeting and merging into a biased armature third point (133). A biased armature base third edge (134) then extends from the biased armature third point (133) back toward the receptacle clasp second side wall (34) surface and merges into a biased armature fourth point (135). A biased armature base fourth edge (136) then extends from the biased armature fourth point (135) back to the biased armature first point (129). The biased armature base first edge (130), biased armature base second edge (132), biased armature base third edge (134) and biased armature base fourth edge (136) together define the periperphery of a biased armature base first side (137). The biased armature base first side is essentially rectangular and perpendicular to the clasp receptacle second side wall (34) surface and the clasp receptacle bottom wall (33) interior surface. In the preferred embodiment, the biased armature base fourth edge is formed integrally with the clasp receptacle second side wall (34) surface.

The biased armature further has a biased armature base fifth edge (138) extending from the biased armature first point (129) toward the clasp receptacle proximal end wall (40) interior surface, meeting and merging into a biased armature fifth point (139). In the preferred embodiment, the biased armature base fifth edge (138) is formed integrally with the clasp receptacle second side wall (34) surface. The biased armature fifth edge (138) is at a right angle to the biased armature fourth edge (136). A biased armature sixth edge (140) then extends downwardly, away from the biased armature fifth point (139) toward the clasp receptacle bottom wall (33) interior surface, meeting and merging into a biased armature sixth point (141). In the preferred embodiment, the biased armature base sixth edge (140) is formed integrally with the clasp receptacle second side wall (34) surface.

As per FIG. 14, a biased armature base seventh edge (142) then extends from the biased armature sixth point (141), away from the clasp receptacle proximal end wall (40) interior surface toward the clasp receptacle distal end wall (41) interior surface, meeting and merging into the biased armature fourth point (135). The biased armature base fourth edge (136), biased armature base fifth edge (138), biased armature base sixth edge (140) and biased armature base seventh edge (142) together define the periperphery of a biased armature base bottom side (143). Again, in the preferred embodiment, the biased armature is formed integrally with the clasp receptacle second side wall, hence the biased armature base bottom side (143) merges into and becomes one with the clasp receptacle second side wall (34) interior surface.

As per FIGS. 14 and 15, a biased armature base eighth edge (144) extends from the biased armature fifth point (139), away from the clasp receptacle second side wall (34) interior surface, toward the first side wall (32) interior surface, merging into a biased armature seventh point (145). In the preferred embodiment, the length of the biased armature base eighth edge (144) is approximately 1.08 mm. The biased armature base eighth edge (144) is parallel to, and co-planar with, the biased armature base first edge (130). A biased armature base ninth edge (146) then extends downwardly from the biased armature seventh point (145), away from the clasp receptacle top wall (35) interior surface, toward the clasp receptacle bottom wall (33) interior surface, merging into a biased armature eighth point (147). A biased armature base tenth edge (148) then extends from the biased armature eighth point (147) to the biased armature sixth point (141). The biased armature base sixth edge (140), biased armature base eighth edge (144), biased armature base ninth edge (146) and biased armature base tenth edge (148) together define the periphery of a biased armature base second side. The biased armature base first side (137) and biased armature second side (46) are both perpendicular to the clasp receptacle top wall (35) interior surface and perpendicular to the clasp receptacle second side wall (34) interior surface.

As per FIGS. 14 and 15, it should be noted that the length of the biased armature base eighth edge (144) and the biased armature base tenth edge (148) are equal to one another. So too, the length of the biased armature base first edge (130) and the biased armature base third edge (134) are equal to one another. However, it should be further noted that the length of the biased armature base eighth edge (144) and the biased armature base first edge (130) are not equal to one another, with the length of the biased armature base first edge (130) being greater than the length of the biased armature base eighth edge (144).

As per FIGS. 14, a biased armature thin extension first edge (149) extends from the biased armature second point (131), away from the clasp receptacle distal end wall (41) interior surface, the biased armature thin extension first edge extending at an acute angle relative to the biased armature base fifth edge (138), toward the proximal end wall (40) interior surface, to a biased armature ninth point (150). A biased armature thin extension second edge (151) extends from the biased armature third point (133), away from the clasp receptacle distal end wall (41) interior surface, the biased armature thin extension second edge extending at an acute angle relative to the biased armature base fifth edge (138), toward the proximal end wall (40) interior surface, lo a biased armature tenth point (152). The biased armature thin extension first edge (149) and the biased armature thin extension second edge (151) are parallel to and co-planar with one another. A biased armature thin extension third edge (153) then extends upward from the biased armature tenth point (152), away from the clasp receptacle bottom wall (33) interior surface, toward the clasp receptacle top wall (35) interior surface, merging into the biased armature ninth point (150). The biased armature thin extension first edge (149), the biased armature thin extension third edge (153), the biased armature thin extension second edge (151) and the biased armature base second edge (132) together form the periphery of a biased armature thin extension first side (154). The biased armature thin extension first side (154) is perpendicular to the clasp receptacle bottom wall (33) interior surface, and is at an acute angle relative to the clasp receptacle second side wall (34) interior surface.

As per FIGS. 14 and 15, a locking tooth portion first edge (155) extends from the biased armature ninth point (150), away from the clasp receptacle second side wall (34) interior surface toward the clasp receptacle first side wall (32) interior surface, merging into a biased armature eleventh point (156). In the preferred embodiment, the length of the locking tooth portion first edge (155) is approximately 0.87 mm. A locking tooth portion second edge (157) extends from the biased armature tenth point (152), away from the clasp receptacle second side wall (34) interior surface toward the clasp receptacle first side wall (32) interior surface, merging into a biased armature twelfth point (158). A locking tooth portion third edge (159) then extends from the biased armature twelfth point (158), away from the clasp receptacle bottom wall (33) interior surface, toward the clasp receptacle top wall (35) interior surface, meeting and merging into the biased armature eleventh point (156). The biased armature thin extension third edge (153), the locking tooth portion first edge (155), the locking tooth portion third edge (159), and the locking tooth portion second edge (157) together form the periphery of a locking tooth portion first side (160). The locking tooth portion first side (160) and the biased armature base first side (137) are parallel to one another.

As per FIGS. 14 and 15, a locking tooth portion fourth edge (161) extends from the biased armature eleventh point (156), away from the clasp receptacle distal end wall (41) interior surface, toward the proximal end wall (40) interior surface, meeting and merging into a biased armature thirteenth point (162). In the preferred embodiment, the length of the locking tooth portion fourth edge (161) is approximately 3.50 mm. A locking tooth portion fifth edge (163) extends from the biased armature twelfth point (158), away from the clasp receptacle distal end wall (41) interior surface, toward the proximal end wall (40) interior surface, meeting and merging into a biased armature fourteenth point (164). The locking tooth portion fourth edge (161) and the locking tooth portion fifth edge (163) are parallel to and co-planar with one another. A locking tooth portion sixth edge (165) then extends from the biased armature fourteenth point (164), away from the clasp receptacle bottom wall (33) interior surface towards the clasp receptacle top wall (35) interior surface, meeting and merging into the biased armature thirteenth point (162).

As should now be understood, the locking tooth portion fourth edge (161), the locking tooth portion third edge (159), the locking tooth portion fifth edge (163), and the locking tooth portion sixth edge (165) together form the periphery of a locking tooth portion second side (166). The locking tooth portion second side (166) is perpendicular to the clasp receptacle bottom wall (33) interior surface, and is parallel to, though not co-planar with, the biased armature thin extension first side (154).

As per FIGS. 14 and 15, a locking tooth portion seventh edge (167) extends from the biased armature fourteenth point (164), away from the clasp receptacle first side wall (32) interior surface toward the clasp receptacle second side wall (34) interior surface, meeting and merging into a biased armature fifteenth point (168). The locking tooth portion seventh edge is parallel to and co-planar with, the locking tooth portion second edge (157). A locking tooth portion eighth edge (169) extends from the biased armature thirteenth point (162), away from the clasp receptacle first side wall (32) interior surface toward the clasp receptacle second side wall (34) interior surface, meeting and merging into a biased armature sixteenth point (170). In the preferred embodiment, the length of the locking tooth portion eighth edge (169) is approximately 1.54 mm. The locking tooth portion eighth edge is parallel to and co-planar with, the locking tooth portion first edge (155). A locking tooth portion ninth edge (171) then extends from the biased armature sixteenth point (170), away from the clasp receptacle lop wall (35) interior surface, toward the clasp receptacle bottom wall (33) interior surface, meeting and merging into the biased armature fifteenth point (168).

As per FIG. 15, it should now be clear that the locking tooth portion eighth edge (169), the locking tooth portion sixth edge (165), the locking tooth portion seventh edge (167), and the locking tooth portion ninth edge (171) together form the periphery of the locking tooth portion flat side (124). The locking tooth portion flat side (124) is parallel to, though not co-planar with, the locking tooth portion first side (160). It should be readily understood that the locking tooth portion eighth edge (169) and the locking tooth portion seventh edge (167) are equal to one another in length. Furthermore, the locking tooth portion first edge (155) and the locking tooth portion second edge (157) are equal to one another in length. However, the locking tooth portion eighth edge (169) and the locking tooth portion first edge (155) are not equal to one another in length, with the locking tooth portion eighth edge (169) having a length greater than the length of the locking tooth portion first edge (155).

Finally, as per FIGS. 14 and 15, a biased armature thin extension fourth edge (172) extends from the biased armature sixteenth point (170), away from the clasp receptacle proximal end wall (40) interior surface toward the clasp receptacle distal end wall (41) interior surface, meeting and merging with the biased armature seventh point (145). In the preferred embodiment, the length of the biased armature thin extension fourth edge (172) is approximately 3.95 mm. A biased armature thin extension fifth edge (173) extends from the biased armature fifteenth point (168), away from the clasp receptacle proximal end wall (40) interior surface toward the clasp receptacle distal end wall (41) interior surface, meeting and merging with the biased armature eighth point (147). The biased armature thin extension fourth edge (172), the locking tooth portion ninth edge (171), the biased armature thin extension fifth edge (173) and the biased armature base ninth edge (146) together form the periphery of a biased armature thin extension second side (174). The biased armature thin extension second side (174) is parallel to, though not co-planar with, the biased armature thin extension first side (154). Furthermore, the biased armature thin extension first side (154) and the biased armature thin extension second side (174) are both perpendicular relative to the clasp receptacle bottom wall (33) interior surface.

Finally, as per FIGS. 14 and 15, the biased armature thin extension fourth edge (172), the locking tooth portion eighth edge (169), the licking tooth portion fourth edge (161), the locking tooth portion first edge (155), the biased armature thin extension first edge (149), the biased armature base first edge (130), the biased armature base fifth edge (138) and the biased armature base eighth edge (144) together form the periphery of a biased armature top side (185). The biased armature thin extension fifth edge (173), the locking tooth portion seventh edge (167), the locking tooth portion fifth edge (163), the locking tooth portion second edge (157), the biased armature thin extension second edge (151), the biased armature base third edge (134), the biased armature base seventh edge (142), and the biased armature base tenth edge (148) together form the periphery of the biased armature thin extension bottom side (186). The biased armature top side (185) and the biased armature bottom side (186) are parallel to one another, though not co-planar with one another. Furthermore, the biased armature top side (185) and the biased armature bottom side (186) are both parallel to, though not co-planar with, both the clasp receptacle bottom wall (33) and the clasp receptacle top will (35)

As per FIG. 8, in the preferred embodiment, the biased armature extends from the second side wall (34) interior surface and is positioned on that wall such that it is about equidistant from the clasp receptacle bottom wall (33) interior surface and the clasp receptacle top wall (35) interior surface. The series of ridges (70) is attached to the first side wall (32) interior surface in the same manner so that the series of ridges (70) and the biased armature (71) occupy approximately the same horizontal plane. When the biased armature is in its "at rest state", the locking tooth portion sixth edge (165) is proximate to the series of ridges (70). When Applicant, in reference to the series of ridges, states that "the ridges each having an angled wall and an adjacent flat wall, the angled wall of each ridge being connected to two adjacent flat walls such that the ridges are connected to one another", it should be understood that the ridge flat wall, most proximal to the clasp receptacle proximal end wall interior surface, will in fact be attached to the first side wall interior surface and only one angled wall. So too, it should be understood that the ridge angled wall, most proximal to the clasp receptacle distal end wall interior surface, will in fact be attached to the first side wall interior surface arid only one flat wall. In this fashion, the entry of the double ridged portion between the biased armature and the series of ridges is facilitated because the ridge most proximal to the clasp receptacle distal end wall interior surface acts as a inclined plane, allowing the double ridged portion to effectively "ride up" it, and direct the double ridged portion towards the biased armature and the clasp receptacle proximal end wall interior surface.

Figure 11:
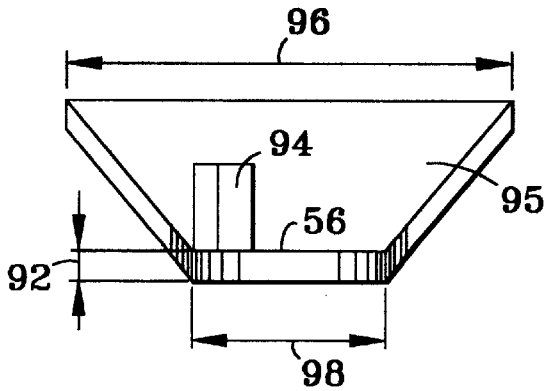
FIG. 11 is an end on view of the clasp tab of the safety cap and seal retainer.

As per FIGS. 1, 2 and 11 the second strap (3) further has a second strap second bendable area (23). The second strap second bendable area is similar to the third bendable area, and is locatable near the second strap distal end (27). The second strap then merges into and becomes one with a second strap angled portion (95). The second strap angled portion has a first width (96) identical to strap width (6), where the second strap angled portion and the second strap merge and become one. The second strap angled portion (95) then proceeds away from the cap (1), at an acute angle, downwardly and away from the cap inner wall (12). The second strap angled portion narrows as it proceeds away from the cap so that its second width (97) is less than its first width (96), the second width being locatable distally of the first width.

As per FIGS. 1, 9, 5 and 10, the clasp tab (56) is the structural element of the instant device which, when the device is fully assembled, engages and locks into the clasp receptacle (28) by interlocking with the clasp receptacle series of ridges (70) and the biased armature (71). The clasp tab merges into and becomes one with the second strap angled portion (95) at the most distal end of the second strap angled portion. The clasp tab (56) is essentially rectangular in shape, and has a clasp tab width (98) equal to the second strap angled portion second width (97). In the preferred embodiment, the clasp tab width is approximately 5.54 mm. The clasp tab length (99) is such that when the device is in operation, the clasp tab having been inserted into the clasp tab receptacle (28), the clasp tab may pass through the distal end wall receptacle opening (29), engage the series of ridges (70) and the biased armature (71), and extend out of the clasp receptacle (28) through the proximal end wall opening (69). In the preferred embodiment, the most distal end of the clasp tab is somewhat rounded, easing its insertion between the biased armature (71) and the series of ridges (70). Furthermore, in the preferred embodiment, the clasp tab length (99) is approximately 16.86 mm.

Figure 9:
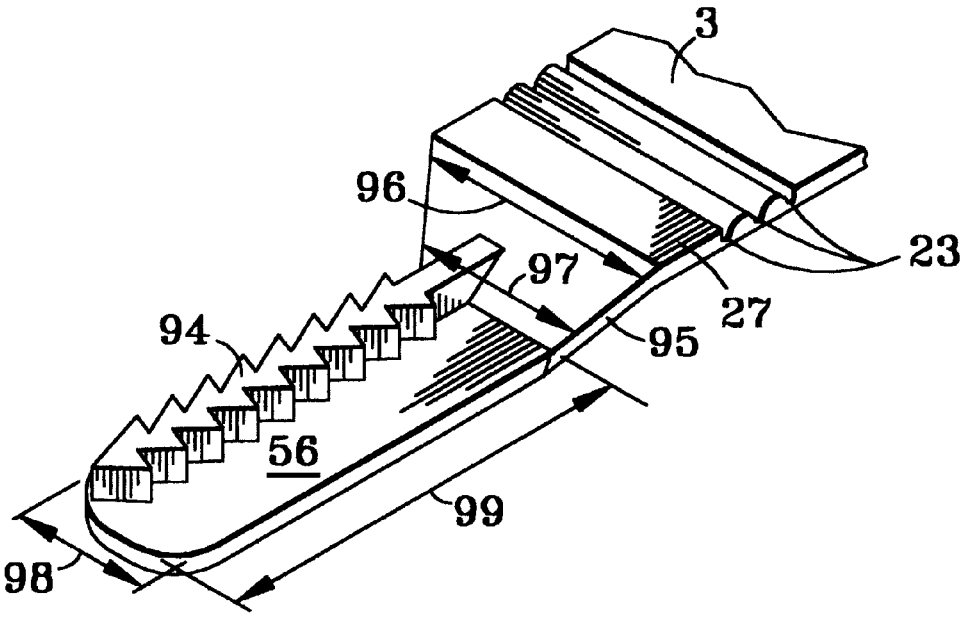
FIG. 9 is a perspective view of the clasp tab of the compressed gas cylinder safety cap.
Figure 10:
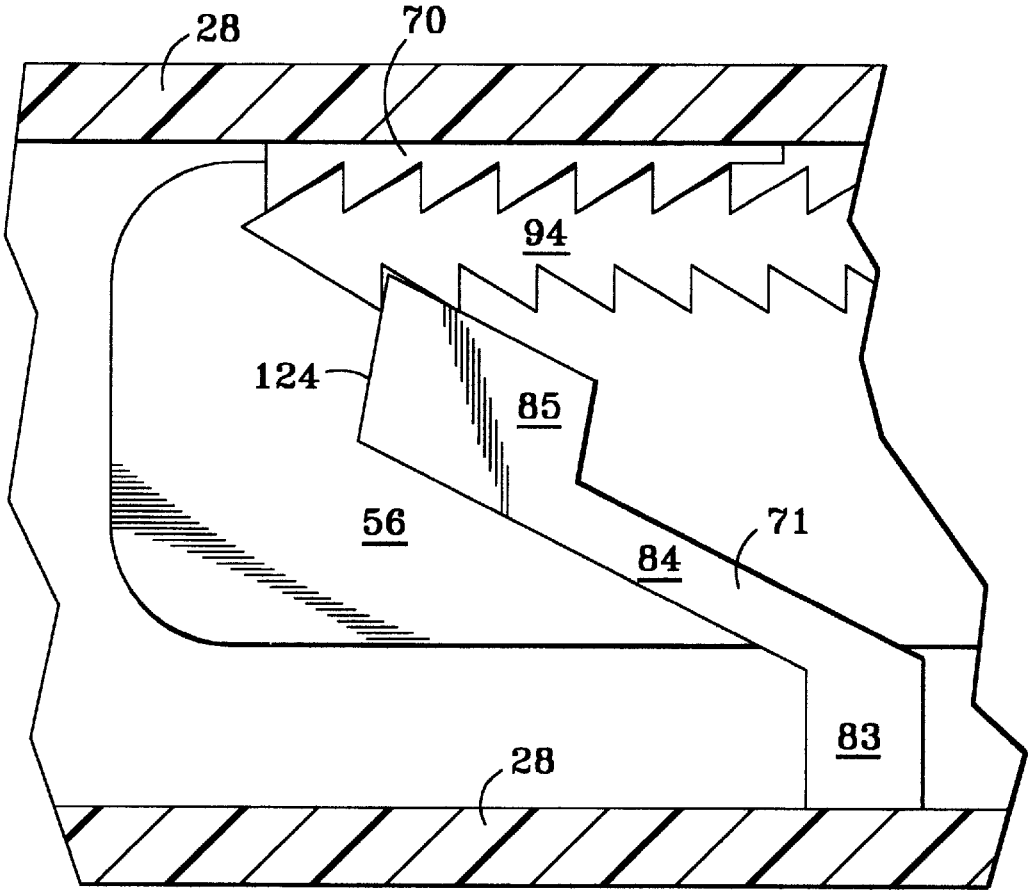
FIG. 10 is a close up cross sectional view of a portion of the clasp receptacle showing the clasp tab engaged with the series of ridges and the biased armature of the clasp receptacle.

As per FIG. 9, the clasp tab (56) has a double ridged portion (94). The double ridged portion extends upwardly from the clasp, perpendicularly to the clasp tab width (98) and the clasp tab length (99). In the preferred embodiment, the height of the double ridged portion is approximately 1.78 mm. Like the clasp receptacle series of ridges (70), the clasp tab double ridged portion is configured such that it includes a series of peaks and valleys.

Figure 12:
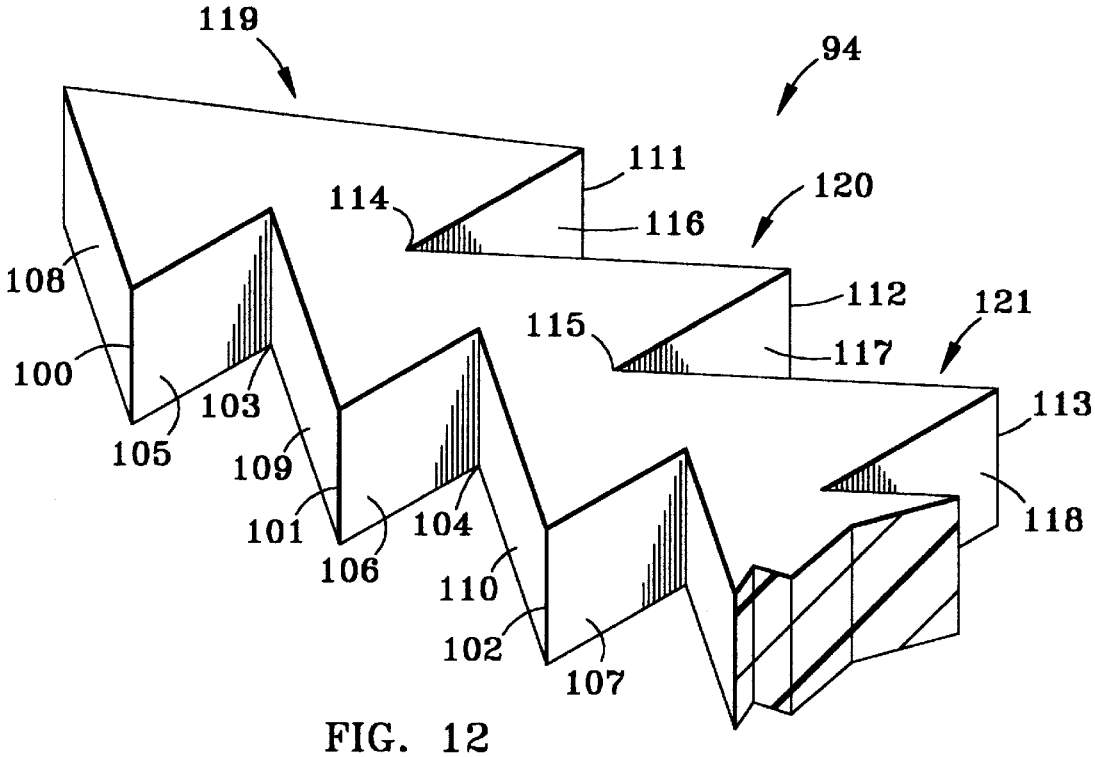
FIG. 12 is a perspective view of a portion of the clasp tab double ridged portion.
Figure 13:
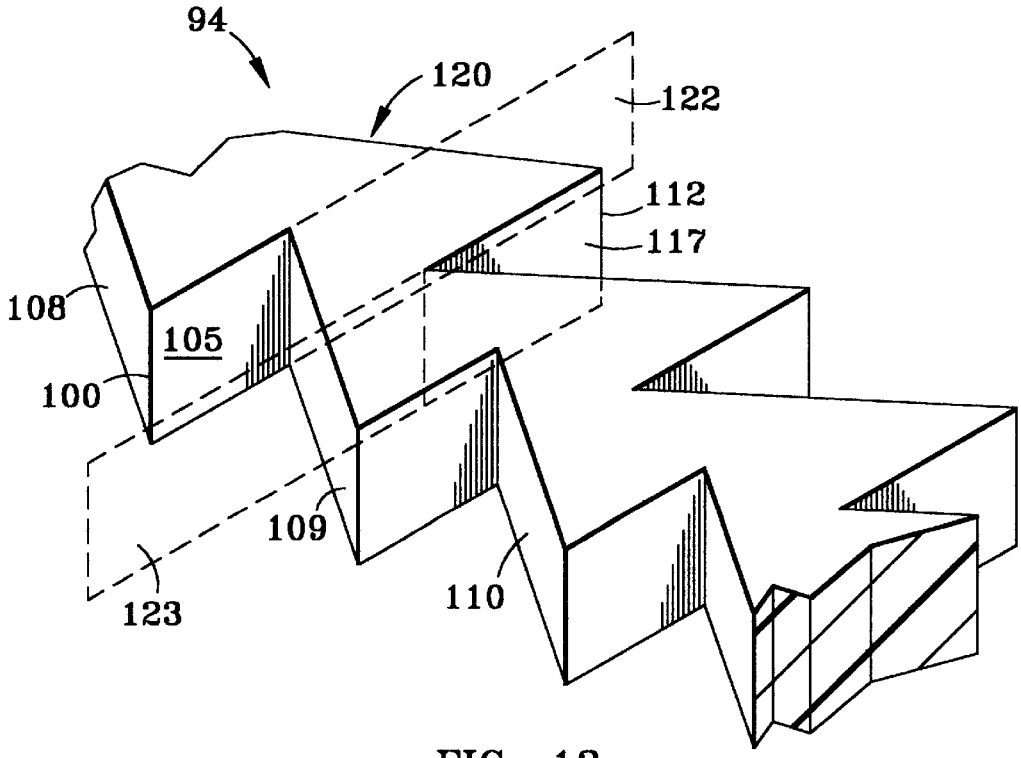
FIG. 13 is another perspective view of a portion of the clasp tab double ridged portion.

As per FIGS. 9, 12 and 13, in order to better understand the double ridged portion (94), it is useful to define the double ridged portion as a first set and second set of ridges which are essentially "wedges" or three dimensional inclined planes. In the preferred embodiment, the two sets of ridges (wedges) are slightly offset from one another. The first set of "wedges" are lined up adjacent to one another, in a manner similar to the clasp receptacle series of ridges, creating a series of peaks; a double ridged portion first peak (100), a double ridged portion second peak (101), and a double ridged portion third peak (102) and valleys; a double ridged portion first valley (103) and a double ridged portion second valley (104). Locatable between each double ridged portion peak (100), (101) and (102) and double ridged portion valley (103) and (104) is a double ridged portion flat wall; a double ridged portion first flat wall (105), a double ridged portion second flat wall (106) and a double ridged portion third flat wall (107). Furthermore, each double ridged portion peak (100), (101) and (102) is connected to each valley (103) and (104) by a double ridged portion angled wall; a double ridged first angled wall (108), a double ridged second angled wall (109) and a double ridged third angled wall (110) In essence, each peak is the juncture of the double ridged angled wall and double ridged flat wall where, when the clasp tab (56) has been inserted into the clasp receptacle (28), the ridge extends towards the clasp receptacle second side wall (34) inner surface.

For example, the double ridged portion first angled wall (108) meets and merges into the double ridged portion first flat wall (105) at the double ridged portion first peak (100), and may be referred to as the double ridged portion first set of ridges first ridge. The double ridged portion first flat wall (105) then meets and merges into the double ridged portion second angled wall (109) at the double ridged portion first valley (103). In the preferred embodiment, the length of the double ridged portion first flat wall (105) is 0.47 mm. The double ridged portion second angled wall (109) then meets and merges into the double ridged portion second flat wall (106) at the double ridged portion second peak (101). As should be apparent, the double ridged portion first flat wall (105), the double ridged portion second flat wall (106) and the double ridged portion third flat wall (107) are all parallel to and face the clasp distal end wall (41), though they are not co-planar. While the first set of ridges described above has specifically described only three ridges, it should be understood that in the preferred embodiment the series of ridges will have a plurality of ridges. In the best mode known to applicant there are a sufficient number of ridges in the series so that thirteen peaks are present. The ridge closest to the second strap angled portion may be referred to as the double ridged portion first set of ridges last ridge, while those ridges locatable between the double ridged portion first set of ridges first ridge and the double ridged portion first set of ridges last ridge may be referred to as the double ridged portion first set of ridges mid-ridges. Furthermore, while the length of double ridged first angled wall (108) and the length of the double ridged portion fourth angled wall (119) are 1.89 mm and 1.38 mm. respectively, the remaining double ridged portion angled walls all have a length of approximately 1.02 mm. in the preferred embodiment.

As per FIGS. 9 and 12, the double ridged portion further has a second set of ridges composed essentially of a second set of "wedges". The second set of ridges ("wedges") are lined up adjacent to one another, in a manner similar to the clasp receptacle series of ridges and the first set of ridges, creating a series of peaks; a double ridged portion fourth peak (111), a double ridged portion fifth peak (112), and a double ridged portion sixth peak (113) and valleys; a double ridged portion third valley (114) and a double ridged portion fourth valley (115). Locatable between each double ridged portion peak (111), (112) and (113) and double ridged portion valley (114) and (115) is a double ridged portion flat wall; a double ridged portion fourth flat wall (116), a double ridged portion fifth flat wall (117) and a double ridged portion sixth flat wall (118). Furthermore, each double ridged portion peak (111), (112) and (113) is connected to each valley (114) and (115) by a double ridged portion angled wall; a double ridged portion fourth angled wall (119), a double ridged portion fifth angled wall (120) and a double ridged portion sixth angled wall (121). In essence, each peak is the juncture of the double ridged angled wall and double ridged flat wall where, when the clasp tab (56) has been inserted into the clasp receptacle (28), the ridge extends towards the clasp receptacle first side wall (32) inner surface.

For example, the double ridged portion fourth angled wall (119) meets and merges into the double ridged portion fourth flat wall (116) at the double ridged fourth peak (111), and may be referred to as the double ridged portion second set of ridges first ridge. The double ridged portion fourth flat wall (116) then meets and merges into the double ridged portion fifth angled wall (120) at the double ridged portion third valley (114). The double ridged portion fifth angled wall (120) then meets and merges into the double ridged portion fifth flat wall (117) at the double ridged fifth peak (112). The double ridged portion fifth flat wall (117) then meets and merges into the double ridged portion sixth angled wall (121) at the double ridged portion fourth valley (115). The double ridged portion sixth angled wall (121) then meets and merges into the double ridged portion sixth flat wall (118) at the double ridged portion sixth peak (113). As should be apparent, the double ridged portion fourth flat wall (116), the double ridged portion fifth flat wall (117) and the double ridged portion sixth flat wall (118) are all parallel to and face the clasp distal end wall (41), though they are not co-planar. While the second set of ridges described above has specifically described only three ridges, it should be understood that in the preferred embodiment the series of ridges will have a plurality of ridges. In the best mode known to applicant there are a sufficient number of ridges in the series so that thirteen peaks are present. The ridge closest to the second strap angled portion may be referred to as the double ridged portion second set of ridges last ridge, while those ridges locatable between the double ridged portion second set of ridges first ridge and the double ridged portion second set of ridges last ridge may be referred to as the double ridged portion second set of ridges mid-ridges. As per FIG. 9, the double ridged portion (94) extends to, and merges with, the second strap angled portion (95).

Finally, as was noted above, and as per FIGS. 9 and 12, the double ridged portion first set of ridges and the double ridged portion second set of ridges are laterally offset from one another, resulting in a "staggering" of the double ridge portion first set of ridges relative to the double ridge portion second set of ridges. Applicant believes this is best accomplished by offsetting the double ridged portion second set of ridges by about one half In other words, each peak of the double ridged portion second set of ridges should be locatable at about the mid-point of the opposite double ridged portion first set of ridges' angled wall. As per FIG. 13, purely for purposes of better understanding the "offset", the double ridged portion first flat wall (105) could be extended away from the double ridged portion first peak (100), toward and through the double ridged portion fifth angled wall (120). So doing would cause the posited planar extension (122) of the double ridged portion first flat wall (105) to bisect the double ridged portion fifth angled wall (120). So too, the double ridged portion fifth flat wall (117) could be extended away from the double ridged portion fifth peak (112) toward and through the double ridged portion second angled wall (109). So doing would cause the posited planar extension (123) of the double ridged portion fifth flat wall (117) to bisect the double ridged portion second angled wall (109). This pattern may be repeated for each peak found on the double ridged portion until the double ridged portion merges with the second strap angled portion (95).

The "offsetting" of the peaks of the double ridged portion is not merely an aesthetic design choice, but is instead an important structural feature of the instant invention. As per FIG. 10, Applicant has discovered that by offsetting the peaks in this fashion, there is a more positive engagement of the double ridged portion (94) with the series of ridges (70) and the biased armature (71). This positive engagement serves to ensure that once the double ridged portion (94) has been inserted between the series of ridges (70) and the biased armature (71), it cannot be withdrawn from the clasp receptacle. This is due to the fact that once the double ridged portion (94) has engaged the series of ridges (70), the double ridged portion second set of flat walls and series of ridges' flat walls will be parallel to and in contact with one another. Furthermore, the locking tooth portion flat side flat side (124) will positively engage one of the double ridge portion first set of flat walls, thereby pinning the double ridged portion (94) between the series of ridges (70) and the biased armature (71). Any attempt to pull the clasp tab (56) from within the clasp receptacle (28) will merely force the locking tooth portion flat side (124) more tightly against the double ridged portion flat wall with which it is engaged. When Applicant refers to the angled wall of each ridge being connected to two adjacent flat walls, such that the ridges are connected to one another, it should be understood that the angled walls (119) and (108) of the two "wedges" most distal from the second strap angled portion are attached to one another and then are attached to their adjacent flat walls (105) and (116). In the preferred embodiment, the length of the double ridged portion fourth angled (119) is approximately 1.38 mm., while the length of the double ridged first angled wall (108) is approximately 1.89 mm. This arrangement facilitates insertion of the double ridged portion between the clasp receptacle biased armature and the clasp receptacle series of ridges by providing a pair of inclined planes which essentially form a triangularly shaped wedge which, when inserted through the clasp receptacle, forces the biased armature away from the series of ridges. Furthermore, the end of the double ridged portion most proximal to the second strap angled portion terminates and merges into the second strap angled portion such that those flat walls at the terminus of the double ridged portion are each attached to only one angled wall before merging into the second strap angled portion.

As per FIGS. 8 and 11, it should be noted that the biased armature (71) should be locatable on the clasp receptacle second side wall (34) interior surface such that there is a first space (175) between the biased armature (71) and the clasp receptacle second side wall (33) interior surface. So too, the series of ridges (70) should be locatable on the clasp receptacle first side wall (32) interior surface such that there is a second space (176) between the series of ridges (70) and the clasp receptacle bottom wall (33) interior surface. In the preferred embodiment, the first space (175) and the second space (176) are equal to one another, however, whether they are equal to one another or not, the critical issue is that they be somewhat larger than a clasp tab thickness (92). In the preferred embodiment, the clasp tab thickness (92) is approximately 0.71 mm. This permits the clasp tab (56) to pass through the clasp receptacle hollow interior (55) by passing between the clasp receptacle bottom wall (33) interior surface, while the clasp tab double ridge portion (94) engages the biased armature (71) and the series of ridges (70).

Those familiar with the art of manufacturing articles such as the instant invention will quickly note that fabrication of the series of ridges (70) and biased armature (71) within the hollow interior (55) of the clasp receptacle (28) will be very difficult to achieve if the clasp receptacle top wall (35) and or bottom wall (33) are solid and prevent access to the hollow interior (55). Applicant believes that it is possible to include an opening in the clasp receptacle top wall (35) and or clasp receptacle bottom wall (33) in order to alleviate this manufacturing difficulty. However, it is imperative that any opening provided in the clasp receptacle bottom wall have length and width (or peripheral) dimensions sufficiently small so that when the clasp tab (56) is inserted into the clasp receptacle, the clasp tab will completely cover any such opening, thus blocking the biased armature (71), the series of ridges (70) and the double ridged portion (94) from view and tampering. Should an opening be desired in the clasp receptacle top wall, the circumferential or length and width dimensions any such opening should be no greater than necessary so as not to weaken the structure of the clasp receptacle. Tampering through any opening in the clasp receptacle top wall should not be a concern as the top wall will be in direct contact with the compressed gas cylinder valve body when fully assembled, thereby preventing access to said opening.

As per FIGS. 6, 9, 10 and 17, the operation of the instant device may now be completely understood. The user of the device mounts the valve seal (177) onto the stem (13) by pressing the valve seal over the stem, and pushing the valve seal toward the cap floor (11), prior to attaching the instant device to the compressed gas cylinder valve (189). The user of the device places the instant invention against the compressed gas cylinder valve such that the first strap dorsal surface (125) and the second strap dorsal surface (127) come into contact with the compressed gas cylinder valve exterior surface (191). The user of the device ensures proper location of the instant device by inserting the stem (13) into the compressed gas cylinder valve aperture (190). The user then bends the device at the four bendable areas (15), (16), (22) and (23) so that the device wraps around the compressed gas cylinder valve. By so doing, the cap (1) will be lined up with the compressed gas cylinder valve aperture such that the instant invention's stem (13) with its attached valve seal (177) extends into the compressed gas cylinder valve aperture, thereby preventing the valve seal from becoming disassociated from the compressed gas cylinder.. The user next inserts the clasp tab (56) into the clasp receptacle (28). While so doing, the user will feel and or hear the clasp tab double ridged portion (94) interlocking with the series of ridges (70) and the biased armature (71). It should be clear that the angle of the second strap angled portion (95) should be such that once the device is wrapped around the compressed gas cylinder valve (189), the first strap dorsal surface (125), the second strap dorsal surface (127), the clasp receptacle bottom wall (33) exterior surface and the most distal end (27) of the second strap dorsal surface (127) will all be in contact with the compressed gas cylinder valve body exterior surface (191).

Once so interlocked, the user is assured that the device will remain firmly in place, thus preventing the intrusion of unwanted materials while at the same time maintaining the valve seal in association with the compressed cylinder valve for later use.

Finally, when the contents of the compressed gas cylinder are required, one merely grasps the tear tab (17) and pulls it away from the compressed gas cylinder valve (189), causing the second strap (3) to tear along the perforations (21), thereby freeing the instant invention from the compressed gas cylinder. The compressed gas cylinder valve aperture (190) is thereby accessible, and the compressed gas cylinder valve seal (177) is made available for use.

It should be noted that in the preferred embodiment, Applicant's device is manufactured from polyproplene plastic. Furthermore, it should be understood that the series of ridges is solid, and formed integrally with the wall upon which it is locatable. The double ridged portion is also solid and formed integrally with the clasp tab upon which it is locatable.

I claim:

1. A compressed gas cylinder safety cap and valve seal retainer comprising;

A. a cap,
- I. the cap having a floor,
  - a. the floor being discoidal in form,
- II. the cap having a cap inner wall, the cap inner wall being circumferentially attached to the cap floor and extending perpendicularly away from the cap floor,
- III. the cap having a stem,
  - a. the stem being attached to, and extending perpendicularly away from, the cap floor, co-axially with the cap inner wall, B. a second strap,
- I. the second strap having a dorsal surface and a ventral surface, a second strap width, a second strap thickness, a proximal end and a distal end,
  - a. the second strap dorsal surface being connected to the second strap ventral surface along a second strap first side and a second strap second side,
  - b. the second strap proximal end being attached to the cap, perpendicularly in relation to the cap inner wall and parallel in relation to the cap floor,
- II. the second strap having a second strap first bendable area,
  - a. the second strap first bendable area being locatable near the proximal end of the second strap,
- III. the second strap having a second strap second bendable area,
  - a. the second strap second bendable area being locatable near the distal end of the second strap,
- IV. the second strap dorsal surface being parallel to the cap floor, C. a safety cap and valve seal retainer removal means,
- I. the safety cap and valve seal retainer removal means being attached to the second strap,
- II. the safety cap and valve seal retainer removal means for providing a controlled and predictable means for removing the safety cap and valve seal retainer after said safety cap and valve seal retainer has fulfilled its intended use,
- III. the second strap having a second strap angled portion,
  - a. the second strap angled portion being attached to the second strap at the second strap distal end,
  - b. the second strap angled portion having a second strap angled portion first width and a second strap portion second width,
    - i. the second strap angled portion first width being similar to the second strap width,
    - ii. the second strap angled portion second width being less than the second strap angled portion first width,
    - iii. the second strap angled portion first width being locatable proximate to the second strap distal end,
  - c. the second strap angled portion extending away from the second strap, downwardly and away from the second strap fourth bendable area, D. a clasp tab,
- I. the clap tab being attached to the second strap angled portion, proximate to the second strap angled portion second width,
- II. the clasp tab having clasp tab width, clasp tab length, and clasp tab thickness,
  - a. the clasp tab width and the second strap angled portion second width being equal,
  - b. the clasp tab thickness being equal to the second strap thickness,
- III. the clasp tab having a double ridged portion,
  - a. the double ridged portion extending upwardly from the clasp tab, perpendicularly to the clasp tab width and the clasp tab length,
  - b. the clasp tab double ridged portion having a length less than the clasp tab length, E. a first strap,
- I. the first strap having a dorsal surface and a ventral surface, a first strap width, a first strap thickness, a proximal end and a distal end,
  - a. the first strap dorsal surface being connected to the first strap ventral surface along a first strap first side and a first strap second side edge,
  - b. the first strap proximal end being attached to the cap, perpendicularly to the cap inner wall, and parallel to the cap floor,
- II. the first strap having a first strap first bendable area,
  - a. the first strap first bendable area being locatable near the proximal end of the first strap,
- III. the first strap having a first strap second bendable area,
  - a. the first strap second bendable area being locatable near the distal end of the first strap,
- IV. the first strap and the second strap being oppositely aligned on the cap portion,
- V. the first strap dorsal surface and the second strap dorsal surface being co-planar, F. a clasp receptacle,
- I. the clasp receptacle being attached to the distal end of the first strap, distally of the first strap second bendable area,
- II. the clasp receptacle having a first side wall, the first side wall having an interior surface and an exterior surface,
- III. the clasp receptacle having a bottom wall, the bottom wall having an interior surface and an exterior surface,
  - a. the bottom wall being attached to the first side wall along a first edge,
- IV. the clasp receptacle having a second side wall, the second side wall having an interior surface and an exterior surface, a. the second side wall being attached to the bottom wall along a second edge, b. the second side wall being perpendicular to the first strap dorsal surface, V. the clasp receptacle having a top wall, the top wall having an interior surface and an exterior surface, a. the top wall being attached to the second side wall along a third edge, b. the top wall being attached to the first side wall along a fourth edge, VII. the clasp receptacle having a distal end wall, a. the distal end wall being connected to the top wall by a ninth edge, b. the distal end wall being attached to the first side wall by a tenth edge, c. the distal end wall being attached to the bottom wall by an eleventh edge, d. the distal end wall being attached to the second side wall by a twelfth edge, e. the distal end wall being perpendicular to the second side wall and the first strap dorsal surface, f. the distal end wall having a clasp receptacle first opening, i. the clasp receptacle first opening passing entirely through the distal end wall exterior surface and the distal end wall interior surface, ii. the clasp receptacle first opening being sized and shaped for the insertion therethrough of the clasp tab and clasp tab double ridged portion, VIII. the clasp receptacle having a proximal end wall, a. the proximal end wall having an interior surface and an exterior surface, b. the proximal end wall being connected to the top wall and to the first strap distal end by a fifth edge, c. the proximal end wall being attached to the first side wall by a sixth edge, d. the proximal end wall being attached to the bottom wall by a seventh edge, e. the proximal end wall being attached to the second side wall by an eighth edge, f. the proximal end wall being perpendicular to the second side wall and the first strap dorsal surface, g. the proximal end wall having a clasp receptacle second opening, i. the clasp receptacle second opening passing entirely through the proximal end wall exterior surface and the proximal end wall interior surface, ii. the clasp receptacle second opening being a mirror image of the clasp receptacle first opening, iii. the clasp receptacle second opening being sized and shaped for the insertion snugly therethrough of the clasp tab and clasp tab double ridged portion, h. the proximal end wall interior surface, the distal end wall interior surface, the top wall interior surface, the first side wall interior surface, the bottom wall interior surface, and the second side wall interior surface collectively defining a clasp receptacle hollow interior, IX. the clasp receptacle having a series of ridges, a. the series of ridges being locatable on the clasp receptacle first side wall interior surface, b. the series of ridges being locatable sufficiently far from the clasp receptacle bottom wall interior surface such that the clasp tab may pass beneath the series ridges without contacting the series and ridges and without contacting the clasp receptacle bottom wall interior surface, X. the clasp receptacle having a biased armature, a. the biased armature being locatable on the clasp receptacle second side wall interior surface, b. the biased armature extending into the clasp receptacle hollow interior, away from the second side wall interior surface and toward the series of ridges, and in close proximity to the series of ridges, c. the biased armature being locatable sufficiently far from the clasp receptacle bottom wall interior surface such that the clasp tab may pass beneath the biased armature without contacting the biased armature and without contacting the clasp receptacle bottom wall interior surface, XI. the clasp receptacle being sized such that the clasp tab may extend into the clasp receptacle distal end wall receptacle opening, through the clasp receptacle hollow interior and out of the clasp receptacle proximal end wall receptacle opening, when the safety cap and valve seal retainer is in use.

2. The safety cap and valve seal retainer according to claim 1, the safety cap and valve seal retainer removal means further comprising;

A. a tear tab,

I. the tear tab having a right edge, a terminating edge, and a left edge, a. the tear tab right edge being connected to the second strap first side, b. the tear tab terminating edge being connected to the tear tab right edge, distally from the second strap first side, c. the tear tab left edge being connected to the tear tab terminating edge and to the second strap first side, d. the tear tab right edge and the tear tab left edge being parallel to one another, and perpendicular to and co-planar with, the tear tab terminating edge, II. the tear tab being locatable between the second strap first bendable area and the second strap second bendable area, B. tear tab perforations, I. the perforations passing completely through the second strap dorsal surface and the second strap ventral surface, II. the perforations being locatable between the second strap first side and the second strap second side, III. the perforations being in line with the tear tab right edge and the tear tab left edge.

3. The safety cap and valve seal retainer according to claim 1, the safety cap and valve seal retainer removal means further comprising;

A. a tear tab,

I. the tear tab having a right edge, a terminating edge, and a left edge, a. the tear tab right edge being connected to the second strap second side, b. the tear tab terminating edge being connected to the tear tab right edge, distally from the second strap second side, c. the tear tab left edge being connected to the tear tab terminating edge and to the second strap second side, d. the tear tab right edge and the tear tab left edge being parallel to one another, and perpendicular to and co-planar with, the tear tab terminating edge, II. the tear tab being locatable between the second strap second bendable area and the second strap first bendable area, B. tear tab perforations, I. the perforations passing completely through the second strap dorsal surface and the second strap ventral surface, II. the perforations being locatable on the second strap dorsal surface between the second strap first side and the second strap second side, III. the perforations being in line with the tear tab right edge and the tear tab left edge.

4. The safety cap and valve seal retainer according to claim 1, the clasp receptacle series of ridges further comprising;

A. a plurality of ridges,

I. the ridges being adjacent to one another, a. the ridges being defined further as a first ridge, the first ridge being most proximate to the clasp receptacle proximal end wall, last ridge, the last ridge being most proximate to the clasp receptacle distal end wall, and mid-ridges, the mid-ridges being locatable between the first ridge and the last ridge, I. the ridges each having an angled wall and an adjacent flat wall, II. the angled wall of the first ridge being connected to one flat wall, III. the angled wall of the last ridge being connected to one flat wall, IV. the mid-ridges each ridge being connected to two adjacent flat walls, such that the mid-ridges are connected to one another as well as to the first ridge and the last ridge.

5. The safety cap and valve seal retainer according to claim 1, the clasp receptacle biased armature further comprising;

A. a base portion

I. the base portion being the locus of attachment of the biased armature to the clasp receptacle second side interior surface, B. a thin extension portion, I. the thin extension portion being attached to, and extending away from, the base portion, at an acute angle relative to the clasp receptacle second side wall, C. a locking tooth portion, I. the locking tooth portion being attached to the thin extension portion, II. the locking tooth portion having a locking tooth portion flat side, a. the locking tooth portion flat side being parallel to the clasp receptacle proximal end wall interior surface, III. the locking tooth portion being in close proximity to the clasp receptacle series of ridges when the biased armature is in an at rest state.

6. The safety cap and valve seal retainer according to claim 1, the clasp receptacle biased armature further comprising;

A. a base portion,

I. the base portion being the locus of attachment of the biased armature to the clasp receptacle second side interior surface, II. the base portion having base portion width, B. a thin extension portion, I. the thin extension portion being attached to, and extending away from, the base portion, at an acute angle relative to the clasp receptacle second side wall, II. the thin extension portion having thin extension portion width, a. the thin extension portion width being less than the base portion width, C. a locking tooth portion, I. the locking tooth portion being attached to the thin extension portion, II. the locking tooth portion having a locking tooth portion flat side, a. the locking tooth portion flat side being parallel to the clasp receptacle proximal end wall interior surface, III. the locking tooth portion being in close proximity to the clasp receptacle series of ridges when the biased armature is in an at rest state.

7. The safety cap and valve seal retainer according to claim 1, the clasp tab double ridged portion further comprising;

A. a first set of ridges,

I. the first set of ridges being adjacent to one another, a. the first set of ridges being further defined as a first set of ridges first ridge, the first set of ridges first ridge being most distal from the second strap distal end wall, a first set of ridges last ridge, the first set of ridges last ridge being most proximal to the second strap distal end, distal end wall, and first set of ridges mid-ridges, the first set of ridges mid-ridges being locatable between the first set of ridges first ridge and the first set of ridges last ridge, II. the first set of ridges each having an angled wall and an adjacent flat wall, III. the angled wall of the first set of ridges first ridge being connected to one flat wall, IV. the angled wall of the first set of ridges last ridge being connected to one flat wall, V. the first set of mid-ridges each ridge being connected to two adjacent flat walls, such that the first set of ridges mid-ridges are connected to one another as well as to the first set of ridges first ridge and the first set of ridges last ridge, B. a second set of ridges, I. the second set of ridges being adjacent to one another, a. the second set of ridges being defined further as a second set of ridges first ridge, the second set of ridges first ridge being most distal from the second strap distal end wall, a second set of ridges last ridge, the second set of ridges last ridge being most proximal to the second strap distal end, distal end wall, and second set of ridges mid-ridges, the second set of ridges mid-ridges being locatable between the second set of ridges first ridge and the second set of ridges last ridge, II. the second set of ridges each having an angled wall and an adjacent flat wall, III. the angled wall of the second set of ridges first ridge being connected to one flat wall, IV. the angled wall of the second set of ridges first ridge being connected to the angled wall of the first set of ridges first wall, V. the angled wall of the second set of ridges last ridge being connected to one flat wall, VI. the second set of mid-ridges each ridge being connected to two adjacent flat walls, such that the first set of ridges mid-ridges are connected to one another as well as to the second set of ridges first ridge and the second set of ridges last ridges, VII. the second set of ridges being attached to the first set of ridges such that second set of ridges flat walls are parallel to and locatable on a common horizontal plane with, the first set of ridges flat walls, VIII. the second set of ridges further being attached to the first set of ridges such that the second set of ridges flat walls are offset from the first set of ridges flat walls.

8. A compressed gas cylinder safety cap and valve seal retainer comprising;

A. a cap,

I. the cap having a floor, a. the floor being discoidal in form,

II. the cap having a cap inner wall, the cap inner wall being circumferentially attached to the cap floor and extending perpendicularly away from the cap floor, III. the cap having a stem, a. the stem being attached to, and extending perpendicularly away from, the cap floor, co-axially with the cap inner wall, B. a second strap, I. the second strap having a dorsal surface and a ventral surface, a second strap width, a second strap thickness, a proximal end and a distal end, a. the second strap dorsal surface being connected to the second strap ventral surface along a second strap first side and a second strap second side, b. the second strap proximal end being attached to the cap, perpendicularly in relation to the cap inner wall and parallel in relation to the cap floor, II. the second strap having a second strap first bendable area, a. the second strap first bendable area being locatable near the proximal end of the second strap, III. the second strap having a second strap second bendable area, a. the second strap second bendable area being locatable near the distal end of the second strap, IV. the second strap dorsal surface being parallel to the cap floor, V. the second strap having a second strap angled portion, a. the second strap angled portion being attached to the second strap at the second strap distal end, b. the second strap angled portion having a second strap angled portion first width and a second strap portion second width, i. the second strap angled portion first width being similar to the second strap width.

ii. the second strap angled portion second width being less than the second strap angled portion first width, iii. the second strap angled portion first width being locatable proximate to the second strap distal end, c. the second strap angled portion extending away from the second strap, downwardly and away from the second strap fourth bendable area, C. a clasp tab, I. the clap tab being attached to the second strap angled portion, proximate to the second strap angled portion second width, II. the clasp tab having clasp tab width, clasp tab length, and clasp tab thickness, a. the clasp tab width and the second strap angled portion second width being equal, b. the clasp tab thickness being equal to the second strap thickness, III. the clasp tab having a double ridged portion, a. the double ridged portion extending upwardly from the clasp tab, perpendicularly to the clasp tab width and the clasp tab length, b. the clasp tab double ridged portion having a length less than the clasp tab length, D. a first strap, I. the first strap having a dorsal surface and a ventral surface, a first strap width, a first strap thickness, a proximal end and a distal end, a. the first strap dorsal surface being connected to the first strap ventral surface along a first strap first side and a first strap second side edge, b. the first strap proximal end being attached to the cap, perpendicularly to the cap inner wall, and parallel to the cap floor, II. the first strap having a first strap first bendable area, a. the first strap first bendable area being locatable near the proximal end of the first strap, III. the first strap having a first strap second bendable area, a. the first strap second bendable area being locatable near the distal end of the first strap, IV. the first strap and the second strap being oppositely aligned on the cap portion, V. the first strap dorsal surface and the second strap dorsal surface being co-planar, D. a safety cap and valve seal retainer removal means, I. the safety cap and valve seal retainer removal means being attached to the first strap, II. the safety cap and valve seal retainer removal means for providing a controlled and predictable means for removing the safety cap and valve seal retainer after said safety cap and valve seal retainer has fulfilled its intended use, E. a clasp receptacle, I. the clasp receptacle being attached to the distal end of the first strap, distally of the first strap second bendable area, II. the clasp receptacle having a first side wall, the first side wall having an interior surface and an exterior surface, III. the clasp receptacle having a bottom wall, the bottom wall having an interior surface and an exterior surface, a. the bottom wall being attached to the first side wall along a first edge, IV. the clasp receptacle having a second side wall, the second side wall having an interior surface and an exterior surface, a. the second side wall being attached to the bottom wall along a second edge, b. the second side wall being perpendicular to the first strap dorsal surface, V. the clasp receptacle having a top wall, the top wall having an interior surface and an exterior surface, a. the top wall being attached to the second side wall along a third edge, b. the top wall being attached to the first side wall along a fourth edge, VII. the clasp receptacle having a distal end wall, a. the distal end wall being connected to the top wall by a ninth edge, b. the distal end wall being attached to the first side wall by a tenth edge, c. the distal end wall being attached to the bottom wall by an eleventh edge, d. the distal end wall being attached to the second side wall by a twelfth edge, e. the distal end wall being perpendicular to the second side wall and the first strap dorsal surface, f. the distal end wall having a clasp receptacle first opening, i. the clasp receptacle first opening passing entirely through the distal end wall exterior surface and the distal end wall interior surface, ii. the clasp receptacle first opening being sized and shaped for the insertion therethrough of the clasp tab and clasp tab double ridged portion, VIII. the clasp receptacle having a proximal end wall, a. the proximal end wall having an interior surface and an exterior surface, b. the proximal end wall being connected to the top wall and to the first strap distal end by a fifth edge, c. the proximal end wall being attached to the first side wall by a sixth edge, d. the proximal end wall being attached to the bottom wall by a seventh edge, e. the proximal end wall being attached to the second side wall by an eighth edge, f. the proximal end wall being perpendicular to the second side wall and the first strap dorsal surface, g. the proximal end wall having a clasp receptacle second opening, i. the clasp receptacle second opening passing entirely through the proximal end wall exterior surface and the proximal end wall interior surface, ii. the clasp receptacle second opening being a mirror image of the clasp receptacle first opening, iii. the clasp receptacle second opening being sized and shaped for the insertion snugly therethrough of the clasp tab and clasp tab double ridged portion, h. the proximal end wall interior surface, the distal end wall interior surface, the top wall interior surface, the first side wall interior surface, the bottom wall interior surface, and the second side wall interior surface collectively defining a clasp receptacle hollow interior, IX. the clasp receptacle having a series of ridges, a. the series of ridges being locatable on the clasp receptacle first side wall interior surface, b. the series of ridges being locatable sufficiently far from the clasp receptacle bottom wall interior surface such that the clasp tab may pass beneath the series ridges without contacting the series and ridges and without contacting the clasp receptacle bottom wall interior surface, X. the clasp receptacle having a biased armature, a. the biased armature being locatable on the clasp receptacle second side wall interior surface, b. the biased armature extending into the clasp receptacle hollow interior, away from the second side wall interior surface and toward the series of ridges, and in close proximity to the series of ridges, c. the biased armature being locatable sufficiently far from the clasp receptacle bottom wall interior surface such that the clasp tab may pass beneath the biased armature without contacting the biased armature and without contacting the clasp receptacle bottom wall interior surface, XI. the clasp receptacle being sized such that the clasp tab may extend into the clasp receptacle distal end wall receptacle opening, through the clasp receptacle hollow interior and out of the clasp receptacle proximal end wall receptacle opening, when the safety cap and valve seal retainer is in use.

9. The safety cap and valve seal retainer according to claim 8, the safety cap and valve seal retainer removal means further comprising;

A. a tear tab,

I. the tear tab having a right edge, a terminating edge, and a left edge, a. the tear tab right edge being connected to the first strap first side, b. the tear tab terminating edge being connected to the tear tab right edge, distally from the first strap first side, c. the tear tab left edge being connected to the tear tab terminating edge and to the first strap first side, d. the tear tab right edge and the tear tab left edge being parallel to one another, and perpendicular to and co-planar with, the tear tab terminating edge, II. the tear tab being locatable between the first strap first bendable area and the first strap second bendable area, B. tear tab perforations, I. the perforations passing completely through the first strap dorsal surface and the first strap ventral surface, II. the perforations being locatable between the first strap first side and the first strap second side, III. the perforations being in line with the tear tab right edge and the tear tab left edge.

10. The safety cap and valve seal retainer according to claim 8, the safety cap and valve seal retainer removal means further comprising;

A. a tear tab,

I. the tear tab having a right edge, a terminating edge, and a left edge, a. the tear tab right edge being connected to the first strap second side, b. the tear tab terminating edge being connected to the tear tab right edge, distally from the first strap second side, c. the tear tab left edge being connected to the tear tab terminating edge and to the first strap second side, d. the tear tab right edge and the tear tab left edge being parallel to one another, and perpendicular to and co-planar with, the tear tab terminating edge, II. the tear tab being locatable between the first strap second bendable area and the first strap first bendable area, B. tear tab perforations, I. the perforations passing completely through the first strap dorsal surface and the first strap ventral surface, II. the perforations being locatable on the first strap dorsal surface between the first strap first side and the first strap second side, III. the perforations being in line with the tear tab right edge and the tear tab left edge.

11. The safety cap and valve seal retainer according to claim 8, the clasp receptacle series of ridges further comprising;

A. a plurality of ridges,

I. the ridges being adjacent to one another, a. the ridges being defined further as a first ridge, the first ridge being most proximate to the clasp receptacle proximal end wall, last ridge, the last ridge being most proximate to the clasp receptacle distal end wall, and mid-ridges, the mid-ridges being locatable between the first ridge and the last ridge, I. the ridges each having an angled wall and an adjacent flat wall, II. the angled wall of the first ridge being connected to one flat wall, III. the angled wall of the last ridge being connected to one flat wall, IV. the mid-ridges each ridge being connected to two adjacent flat walls, such that the mid-ridges are connected to one another as well as to the first ridge and the last ridge.

12. The safety cap and valve seal retainer according to claim 8, the clasp receptacle biased armature further comprising;

A. a base portion,

I. the base portion being the locus of attachment of the biased armature to the clasp receptacle second side interior surface, B. a thin extension portion, I. the thin extension portion being attached to, and extending away from, the base portion, at an acute angle relative to the clasp receptacle second side wall, C. a locking tooth portion, I. the locking tooth portion being attached to the thin extension portion, II. the locking tooth portion having a locking tooth portion flat side, a. the locking tooth portion flat side being parallel to the clasp receptacle proximal end wall interior surface, III. the locking tooth portion being in close proximity to the clasp receptacle series of ridges when the biased armature is in an at rest state.

13. The safety cap and valve seal retainer according to claim 8, the clasp receptacle biased armature further comprising;

A. a base portion,

I. the base portion being the locus of attachment of the biased armature to the clasp receptacle second side interior surface, II. the base portion having base portion width, B. a thin extension portion, I. the thin extension portion being attached to, and extending away from, the base portion, at an acute angle relative to the clasp receptacle second side wall, II. the thin extension portion having thin extension portion width, a. the thin extension portion width being less than the base portion width, C. a locking tooth portion, I. the locking tooth portion being attached to the thin extension portion, II. the locking tooth portion having a locking tooth portion flat side, a. the locking tooth portion flat side being parallel to the clasp receptacle proximal end wall interior surface, III. the locking tooth portion being in close proximity to the clasp receptacle series of ridges when the biased armature is in an at rest state.

14. The safety cap and valve seal retainer according to claim 8, the clasp tab double ridged portion further comprising;

A. a first set of ridges,

I. the first set of ridges being adjacent to one another, a. the first set of ridges being further defined as a first set of ridges first ridge, the first set of ridges first ridge being most distal from the second strap distal end wall, a first set of ridges last ridge, the first set of ridges last ridge being most proximal to the second strap distal end, distal end wall, and first set of ridges mid-ridges, the first set of ridges mid-ridges being locatable between the first set of ridges first ridge and the first set of ridges last ridge, II. the first set of ridges each having an angled wall and an adjacent flat wall, III. the angled wall of the first set of ridges first ridge being connected to one flat wall, IV. the angled wall of the first set of ridges last ridge being connected to one flat wall, V. the first set of mid-ridges each ridge being connected to two adjacent flat walls, such that the first set of ridges mid-ridges are connected to one another as well as to the first set of ridges first ridge and the first set of ridges last ridge, B. a second set of ridges, I. the second set of ridges being adjacent to one another, a. the second set of ridges being defined further as a second set of ridges first ridge, the second set of ridges first ridge being most distal from the second strap distal end wall, a second set of ridges last ridge, the second set of ridges last ridge being most proximal to the second strap distal end, distal end wall, and second set of ridges mid-ridges, the second set of ridges mid-ridges being locatable between the second set of ridges first ridge and the second set of ridges last ridge, II. the second set of ridges each having an angled wall and an adjacent flat wall, III. the angled wall of the second set of ridges first ridge being connected to one flat wall, IV. the angled wall of the second set of ridges first ridge being connected to the angled wall of the first set of ridges first wall, V. the angled wall of the second set of ridges last ridge being connected to one flat wall, VI. the second set of mid-ridges each ridge being connected to two adjacent flat walls, such that the first set of ridges mid-ridges are connected to one another as well as to the second set of ridges first ridge and the second set of ridges last ridge, VII. the second set of ridges being attached to the first set of ridges such that second set of ridges flat walls are parallel to and locatable on a common horizontal plane with, the first set of ridges flat walls, VIII. the second set of ridges further being attached to the first set of ridges such that the second set of ridges flat walls are offset from the first set of ridges flat walls.

* * * * *